United States Patent [19]

Artzt et al.

[11] Patent Number: 4,893,461

[45] Date of Patent: Jan. 16, 1990

[54] PROCESS AND DEVICE FOR PIECING WITH A SPINNING DEVICE OPERATING WITH A PNEUMATIC TWISTING UNIT

[75] Inventors: Peter Artzt; Harald Dallman, both of Reutlingen; Kurt Ziegler, Kirchheim-Nabern; Gerhard Egbers, Reutlingen, all of Fed. Rep. of Germany

[73] Assignee: Schubert & Salzer Maschinenfabrik Aktiengesellschaft, Ingolstadt, Fed. Rep. of Germany

[21] Appl. No.: 272,990

[22] PCT Filed: Mar. 2, 1988

[86] PCT No.: PCT/DE88/00106

§ 371 Date: Dec. 22, 1988

§ 102(e) Date: Dec. 22, 1988

[87] PCT Pub. No.: WO88/06650

PCT Pub. Date: Sep. 7, 1988

[30] Foreign Application Priority Data

Mar. 2, 1987 [DE] Fed. Rep. of Germany ..... 3706728

[51] Int. Cl.[4] ..... D01H 15/00; D01H 15/02; D01H 5/28

[52] U.S. Cl. ..... 57/261; 57/279; 57/280; 57/328

[58] Field of Search ..... 57/261–263, 57/328, 333, 22, 279, 280

[56] References Cited

U.S. PATENT DOCUMENTS

| | | | |
|---|---|---|---|
| 4,503,662 | 3/1985 | Horiuchi et al. | 57/261 |
| 4,543,776 | 10/1985 | Seiki et al. | 57/328 X |
| 4,545,193 | 10/1985 | Tanaka et al. | 57/261 |
| 4,550,560 | 11/1985 | Tanaka et al. | 57/261 |
| 4,620,413 | 11/1986 | Anahara et al. | 57/328 X |
| 4,769,981 | 9/1988 | Artzt et al. | 57/261 |

*Primary Examiner*—John Petrakes

*Attorney, Agent, or Firm*—Dority & Manning

[57] ABSTRACT

To piece with a spinning device having a pneumatic twisting unit, a yarn end is back-fed from an output side, through the twisting unit, to drawing equipment, and then inserted laterally into a pair of drawing unit output rollers, from where it is drawn off through the twisting unit in the form of a continuous yarn with a rove being incorporated into it. During the back-feeding of the yarn end to the twisting unit input side, the yarn end is conveyed to a grasping device located at the side of the drawing equipment. The grasping device pulls the yarn end for subsequent insertion into the pair of output rollers past such rollers until such end is alongside the drawing equipment. A yarn presenting device is provided to convey to the grasping device the yarn end leaving the twisting unit input side. The yarn presenting device includes a compressed air nozzle oriented essentially parallel to the nip of the pair of output rollers, the outlet of which is located on a side of the twisting unit across from the grasping device and which outlet is also oriented towards the grasping device to convey the yarn end thereto.

69 Claims, 8 Drawing Sheets

FIG. 6
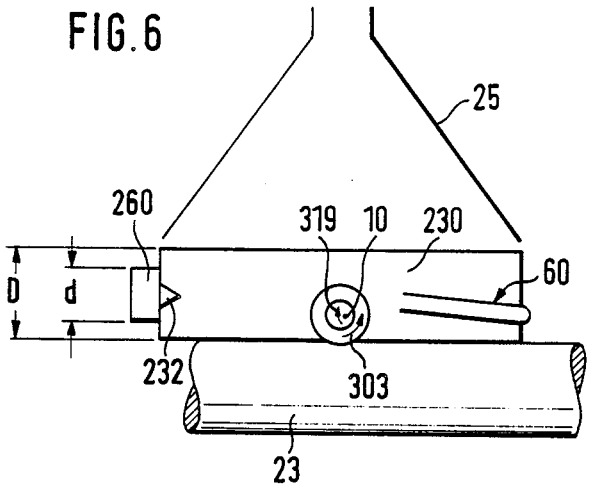
FIG. 7a
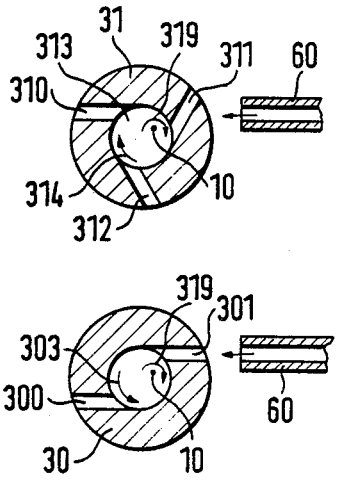
FIG. 7b
FIG. 8
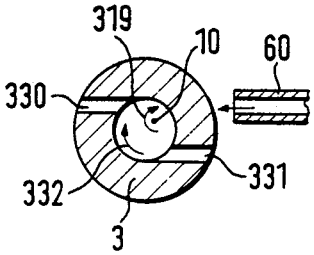

PROCESS AND DEVICE FOR PIECING WITH A SPINNING DEVICE OPERATING WITH A PNEUMATIC TWISTING UNIT

SUMMARY AND BACKGROUND OF THE INVENTION

The instant invention relates to a process for piecing with a spinning device operating with a pneumatic twisting unit, in which a yarn end is backfed from the output side through the twisting unit to a drawing equipment to be then inserted laterally into the pair of output rollers of the drawing equipment, from where it is drawn off through the twisting unit in form of a continuous yarn as the rove is incorporated, and to a device to carry out this process.

In a known process of this type the twisting unit is shifted laterally for piecing, so that its input side becomes accessible (DE-OSen 3,411,577 and 3,413894). A yarn end is then pulled from the bobbin and is introduced into the twisting unit from the output side. A suction pipe is moved to the input side of the twisting unit and pulls the yarn end off through the twisting unit. The twisting unit is then brought back into its spinning position and the yarn segment extending from the twisting unit to the suction pipe is inserted into the output roller pair of the drawing equipment. The spinning process can then be resumed. In this known piecing process it is an advantage that the twisting unit must be shifted laterally for the back-feeding of the yarn end to the drawing equipment. On the one hand, additional space is needed next to the twisting unit for this lateral shifting of said twisting unit which prevents the construction being compact. On the other hand, there is the danger that the twisting unit may not return exactly into its starting position as it is returned, and this would impair the, spinning process and the quality of the yarn.

Since the undisturbed spinning process is to be regarded as the normal state in a spinning device, and the piecing process as an extraordinary situation, terms such as "input side" or "input opening" or "output side" or "output opening" of the twisting unit always refer to this normal state. The "input side" or "input opening" of the twisting unit is thus the side or opening towards the drawing equipment since the yarn in the process of being drawn off reaches the twisting unit on that side in the normal spinning process and leaves the twisting unit on its side away from the drawing equipment.

The "rove", in the sense of the instant invention, is to be taken as being any sliver-like fiber material that can be drawn by means of a drawing equipment and can be fed to the twisting unit, whether or not it has little twist or not. Therefore not only fly roves come under this designation, but also card slivers etc.

It is the object of the instant invention to create a process and a device for piecing a spinning device with a pneumatically operated twisting unit, by means of which a shifting of the twisting unit to back-feed the yarn can be dispensed with, so that a spacesaving construction of the spinning device can be achieved and optimal adjustment of the twisting unit is always ensured for spinning.

This object is attained through the invention in a process of this type in that the yarn end is conveyed through the twisting unit located after the pair of output rollers of the drawing equipment to its input side, in that it is seized there and fed to a grasping device located alongside the drawing equipment, which then draws the yarn end past the output roller pair for later insertion into same. Due to the fact that the yarn emerging from the twisting unit at its input side is seized between the drawing equipment and the twisting unit and is conveyed to a grasping device located alongside the drawing equipment, it is not necessary to shift the twisting unit laterally and the twisting unit can thus always remain in its spinning position.

There must merely be enough space provided along the side of the drawing unit so that a grasping device can be installed which can be moved essentially parallel to the direction of movement of the fiber material and thus requires little space. Due to the fact that the twisting unit also does not change position with respect to the drawing equipment for the piecing operation, an optimal position of the twisting unit in relation to the drawing equipment is ensured before and after the piecing process, so that spinning reliability is increased.

The yarn end which is back-fed through the twisting unit is preferably subjected to a compressed air stream flowing parallel to the nip of the pair of output rollers to convey it to the grasping device. Reliable feeding of the yarn end to the grasping device is thus achieved easily, without precise time control being necessary for this.

If the stream of compressed air which conveys the yarn end to the grasping device is turbulent, the danger exists that the yarn end might be conveyed by the air turbulence past the grasping device which thus cannot seize it. To avoid such malfunctions, the yarn end back-feed through the twisting unit is conveyed to the grasping device by means of a laminar compressed air stream in a preferred version of the process of the invention.

In order to increase the reliability with which the yarn end is fed to the grasping device, a yarn reserve can be alternatively or additionally be provided before the back-feeding of the yarn end through the twisting unit, said yarn reserve being then used up so slowly during back-feeding of the yarn end through the twisting unit into the air stream flowing transversely to the path of the yarn, that the yarn end is held straight while it is being fed to the grasping device by the compressed air stream. The slow dissolution of the yarn reserve causes the yarn end emerging from the input opening of the twisting unit to be gradually seized by the stream of compressed air, so that such a straight-line feeding of the yarn to the grasping device is ensured.

The air stream to which the yarn end is exposed while being back-fed should be as weak as possible so that although it ensures back-feeding, it nevertheless does not dissolve the yarn end. Furthermore, air turbulence should be avoided. For this reason, according to an advantageous characteristic of the process according to the invention, the stream of compressed air is to be switched off as soon as the yarn end has been seized by the grasping device.

At the beginning of the yarn draw-off the individual fibers which detach themselves from the rove have the tendency to catch on the yarn. These individual fibers can however not be incorporated properly and constitute ugly shags and bunching in the finished yarn. If the start of the rove is first fed into a suction device immediately after coming out of the drawing equipment, this rove is subjected to the sucking action of the rove suction as well as to that of the twisting unit when the spinning over-pressure is switched on in the twisting unit. This produces undefined negative pressure conditions in the area between drawing equipment and twisting unit which lead to interference during the piecing process. In order to avoid these disadvantages it is advantageous for the yarn end and the rove to be exposed between the output roller pair of the drawing equipment and the twisting unit to a stream of compressed air which is essentially parallel to the nip of the pair of output rollers upon resumption of yarn draw-off.

If the stream of compressed air directed across the yarn draw-off device remains switched on too long this creates the danger of a thin spot being produced in the newly spun yarn, right after the piecing joint. To avoid this, a further advantageous version of the process provides for the stream of compressed air which was switched on after resumption of yarn draw-off to be switched off even before the yarn end leaves the output roller pair of the drawing equipment.

It has been found that individual fibers which get caught on the yarn being drawn off can be blown away from the yarn with great efficiency if the stream of compressed air is directed tangentially counter to the twist of the core of the yarn extending from the drawing equipment to the twisting unit.

To prevent the back-fed yarn end from untwisting in the air stream while it is subjected to the stream of compressed air directed against the grasping device, a considerably weaker stream of compressed air than the one following resumption of yarn draw-off is preferably provided to act upon the yarn end during yarn back-feeding. The strength of the stream of compressed air is calculated so that the yarn can still be reliably conveyed to the grasping device, but without risk of the yarn end becoming untwisted.

With the passage of time, ever greater deposits accumulate in the twisting unit during the spinning process, coming loose from time to time so that they risk being pulled along by the yarn being drawn off. For this reason the twisting unit is preferably cleaned in combination with the piecing process before or during back-feeding of the yarn. This cleaning can be effected in principle by compressed air prevailing in the twisting unit, even before the yarn end is introduced into the twisting unit to be back-fed to the drawing equipment. Such cleaning can however also be combined with the back-feeding process, for example by using a brush for the back-feeding of the yarn end.

Back-feeding of the yarn end can however be effected with the greatest ease, according to the instant invention, by bringing said yarn end by means of a stream of compressed air from the output side of the twisting unit through said twisting unit and into the range of the stream of compressed air acting transversely to the path of the yarn.

Simple control of the compressed air stream acting transversely to the path of the yarn can be obtained according to the instant invention by allowing said compressed air stream to flow during pneumatic back-feeding of the yarn end through the twisting unit only for as long as the compressed air stream causing the yarn back-feeding action prevails within the twisting unit.

The grasping device is preferably pneumatic, whereby a negative pressure is produced in it at least for the time during which the yarn end is being inserted into the drawing equipment. Such a pneumatic grasping device offers the advantage that it is able to securely take away a yarn end produced by yarn breakage and also that it can serve to remove fibers which are blown off after resumption of the yarn draw-off.

The insertion of the yarn end into the drawing equipment can be effected in principle in different ways. For example, the oblique position of the grasping device which is drawn back parallel or at an angle to the path of the fiber material, may already suffice for this. To obtain also timely defined insertion of the yarn end into the output roller pair of the drawing equipment, provisions are made in an advantageous version of the process according to the instant invention for the fiber end to be pulled in form of a loop into the area between the last two pairs of rollers of the drawing equipment after having been pulled alongside the drawing equipment. It is advantageous for the yarn end to be brought simultaneously into the effective range of a yarn brake as it is pulled in form of a loop into the area between the last two roller pairs of the drawing equipment. This ensures that the yarn end cannot suddenly contract after being released by the grasping device and thus assume a position which would not be parallel to the rove, which would lead to a fault in the piecing joint.

In order to achieve reliable and defined insertion of the yarn end into the pair of output rollers of the drawing equipment, suitable provisions can be made for the yarn end to be brought into the zone of the nip of the pair of output rollers during insertion into the drawing equipment.

According to a preferred version of the process according to invention, the twisting unit is cleaned by a first stream of compressed air directed in the direction going from the output edge of the twisting unit to its input side. The yarn end is then subjected to this first stream of compressed air for the purpose of back-feeding to the input side of the twisting unit to be subjected there to a second stream of compressed air acting transversely to the direction of conveyance and which then feeds the yarn end to a grasping device which then pulls the yarn end past the pair of output rollers until it is at the side of the drawing equipment. The previously stopped rove is then released and is sucked away between the drawing equipment and the twisting unit. Following this, the yarn end extending to the grasping device is fed in form of a loop in the area between the last two pairs of rollers of the drawing equipment to a yarn brake and is at the same time inserted into the pair of output rollers of the drawing equipment. The yarn end is now again subjected to draw-off. At the same time the rove and loose fibers are prevented from being sucked into the twisting unit by switching on the second stream of compressed air. Following this, and before the yarn end has reached the pair of output rollers of the drawing equipment, the suction of the rove and the second compressed air stream are switched off.

According to a further, also very advantageous process, the twisting unit is cleaned by a first compressed air stream flowing counter to the direction of draw-off and the yarn end is then subjected to this first compressed air stream and is brought by it from the output side of the twisting unit to its input side. There, the yarn end is subjected to a second compressed air stream acting transversely to the direction of conveyance and is fed by it to a grasping device which pulls the yarn end past the pair of output rollers until it is the side of the drawing equipment. The yarn end extending to the grasping device is then fed in the area between the last two pairs of rollers of the drawing equipment in form of a loop to a yarn brake and is at the same time inserted into the pair of output rollers of the drawing equipment and is once more drawn off. The previously stopped rove is then released while the rove and loose fibers are prevented from being sucked into the twisting unit by switching on the second stream of compressed air. When the yarn end has been pulled out of the drawing equipment for a predetermined length, the suction of the rove as well as the second compressed air stream are again switched off. Finally the spinning over-pressure taking effect within the twisting unit is also brought to bear in the direction of draw-off.

To carry out the process, a device with a pneumatic twisting unit, a back-feeding unit to back-feed the yarn end from the output side of the twisting unit to its input side and with grasping device to pull back the yarn end from the input opening of the twisting unit, past the pair of output rollers up to the side of the drawing equipment, is provided according to the invention with a yarn presenting device to seize the yarn end emerging from the input side of the twisting unit during back-feeding and to feed it to the grasping device. This yarn presenting device makes it unnecessary for the twisting unit to be shifted laterally for piecing.

The yarn presenting device is preferably made in form of a compressed air nozzle oriented essentially at a parallel to the nip of the pair of output rollers, with its output located on the side of the twisting unit across from the grasping device and turned towards said grasping device.

It has proven advantageous for the twisting unit to be provided with an axial projection at its input side and for the compressed air nozzle to be installed relative to the twisting unit in such manner that the stream of compressed air leaving the compressed air nozzle is tangent to the face of said projection. In this manner the air stream is deflected in the direction of the twisting unit in the area following the projection due to the turbulence created. This causes the yarn end to be removed somewhat from the pair of output rollers of the drawing equipment and this improves security during the feeding of the yarn.

For the twisting unit to be located as close as possible to the rollers of the pair of output rollers, this having been shown to be advantageous for the spinning process, provisions are made in a further embodiment of the device according to the invention for the compressed air nozzle to be located at least partly within the nip of the pair of output rollers of the drawing equipment on the side of the twisting unit. In order to prevent fluff from settling on the upper roller of the pair of output rollers of the drawing equipment, a distance of at least 1 mm is preferably provided between the compressed air nozzle and this upper roller.

The reliability with which the yarn is fed from the twisting unit to the grasping device is increased by a laminar compressed air stream. For this reason, a further preferred characteristic of the invention provides for the output of the compressed air nozzle to have an inside diameter of constant cross-section.

It has been shown to be of special advantage for the compressed air nozzle to be arranged tangentially to the yarn end extending from the drawing equipment to the twisting unit so that the compressed air nozzle is oriented counter to the direction of flow of the compressed air which causes the core twist of the yarn end which is produced by the compressed air bores in the twisting unit. This ensures that the compressed air stream prevents the rove or individual fibers from being pulled into the twisting unit by the yarn end when yarn draw-off has been resumed but before the yarn end has left the drawing equipment.

If a twisting unit with only one single row of compressed air bores opening out tangentially into the axial bore is used, the compressed air nozzle is here oriented tangentially to the prolongation of the axial bore of the twisting unit in a direction opposite to the direction into which the compressed air leaving the compressed air bores flows. If, on the other hand, a twisting unit with two rows of compressed air bores behind each other, of which one row opens out into one peripheral direction and the other row into the opposite peripheral direction into the axial bore of the twisting unit is used, the instant invention provides for the compressed air nozzle to be oriented tangentially to the extended axial bore of the twisting unit in a direction opposite to that peripheral direction into which the compressed air bores of the second row, in the sense of yarn draw-off, let out into the axial bore of the twisting unit.

Since it was shown to be advantageous for the feeding of the yarn end to the grasping device to use as weak an air stream as possible, so that the yarn end does not become untwisted, while a stronger over-pressure is better to blow away individual fibers or the start of the rove from the yarn end being drawn off, a further embodiment of the device according to the invention provides for the compressed air nozzle to be provided with a device for selective application of higher or lower over-pressure.

It is advantageous to control the compressed air nozzle in function of the yarn length which is still present in the drawing equipment. For this reason the compressed air nozzle is suitably provided with a control device and the grasping device with a yarn monitoring unit connected to this control device.

According to a preferred embodiment of the invention, the twisting unit is provided with compressed air bores in addition to the compressed air bores in which over-pressure prevails during the spinning process and which have a component in the direction of draw-off, whereby over-pressure is applied in these additional bores during back-feeding of the yarn and said additional bores having a component in direction of back-feeding. These compressed air bores oriented in back-feeding direction can be subjected to over-pressure for the back-feeding of the yarn end as well as for the cleaning of the twisting unit.

If a twisting unit equipped with an injector nozzle and a twisting nozzle in a row and with a gap between them in yarn draw-off direction, is used for the pneumatic back-feeding of the yarn end through the twisting unit up to the area of the yarn presenting device, there is a danger that the yarn end might get caught in the area between the two nozzles of the twisting unit as it is back-fed. To prevent this, provisions can be made in a further advantageous embodiment of the device according to invention for the injector nozzle as well as the twisting nozzle to be provided with a compressed air bore each, oriented in direction of back-feeding, whereby a stronger air stream can be produced in the injector nozzle than in the twisting nozzle. This can be achieved in different ways, for example through an inclination of the compressed air bore in the twisting nozzle that is different than that of the compressed air bore in the injector nozzle. Preferably for this purpose the compressed air bore in the injection nozzle has a diameter which is larger than that of the compressed air bore in the twisting nozzle.

Since in pneumatic back-feeding of the yarn end the compressed air nozzle need take effect only for the duration of back-feeding in order to prevent untwisting of the yarn end, a simple and practical embodiment of the object of the invention provides for the compressed air bores of the twisting unit and of the compressed air nozzle causing the back-feeding of the yarn end to share one common supply circuit as well as one common control valve.

It is not absolutely necessary for the yarn to be fed back pneumatically through the twisting unit into the area of the yarn presenting device. In an alternative embodiment of the device according to the invention it is also possible to provide for a mechanical threading unit for the back-feeding of the yarn end through the twisting unit and into the lifting range of the yarn presenting device. This threading element is then preferably made in form of a clamp. However an alternative advantageous design of the mechanical threading element is also possible by making it in form of a brush which can be equipped with a stripper. A brush has furthermore the advantage, as compared to a threading element in form of a clamp, that said brush could brush off accumulations that may have been deposited in the axial bore of the twisting unit as it is imparted a relative movement within the twisting unit, and could thus clean the twisting unit.

In order to feed the yarn end in a straight line to the grasping device, and thereby ensuring secure reception of the yarn end by the grasping device, it is advantageous for the yarn end to be back-fed slowly through the twisting unit. In addition it is preferable for the back-feeding length to be defined, so that the length of the piecing joint can also be determined easily in advance. To achieve this goal, a yarn reserve device with a drive is advantageously provided on the output side of the twisting unit, whereby said drive drives the yarn reserve device so slowly that the yarn end leaving the input opening of the twisting unit is straightened by the yarn presenting device during feeding to the grasping device. In principle, different designs are possible for the grasping device, e.g. in form of a pair of rollers which seizes the yarn in the manner of a clamp and draws it out of the twisting unit through its rotation and which, upon an axial shift of the grasping device so that the yarn is held even after being released by the pair of rollers, brings it into range of a stationary suction air opening. However, the preferred design for the grasping device is that of a suction air nozzle which is provided advantageously with a suction opening directed towards the yarn presenting device.

The grasping device not only serves to grasp the yarn end fed to it by the yarn presenting device, but also to insert this yarn end into the pair of output rollers of the drawing equipment. In principle, this too can be done in a variety of ways, for instance with a grasping device made in form of a suction air nozzle where the yarn end emerges through a first covered and later opened slit and thus comes within reach of a yarn inserting device which then inserts the yarn end into the drawing equipment. Suitably, the grasping device is however capable of being moved from a receiving position, in which it works together with the yarn presenting device, into an insertion position at the side of the drawing equipment.

The yarn end can in principle be inserted into the drawing equipment by means of an appropriate movement of the grasping device, but a yarn inserting device is preferably provided for this, said yarn inserting device being capable of being moved from a readiness position at the side of the drawing equipment into an insertion position in such manner that it crosses the path of the yarn end extending from the twisting unit to the grasping device and introduces it in its subsequent movement into the drawing equipment. In this area of the drawing equipment a yarn brake to which the yarn end can be conveyed in its insertion movement, is suitably provided. The yarn end can be retained by this yarn brake even after release by the grasping device, so that a parallel position of the yarn end in relation to the rove is ensured during the entire yarn draw-off movement.

The yarn brake can be located in principle at any point of the yarn path between grasping device and the pair of output rollers of the drawing equipment; every effort is made however to install this yarn brake as close as possible to the pair of output rollers of the drawing equipment so that the yarn end is controlled practically over the entire distance between grasping device and the pair of output rollers. For this reason, this brake is advantageously located between the last two pairs of rollers of the drawing equipment. It is especially advantageous if the yarn inserting device and the yarn brake together constitute an elastic yarn clamp when the yarn inserting device is in its inserting position. The yarn brake against which the yarn inserting device presses the yarn end is preferably equipped with a clamping surface made of soft rubber or felt.

In order to ensure rapid introduction of the yarn end into the pair of output rollers of the drawing equipment, provisions are made in a further embodiment of the device according to the invention for the upper roller of the pair of output rollers of the drawing equipment to be provided with a yarn guide which holds the yarn end during pull-back to the side of the drawing equipment up to the moment of insertion into said drawing equipment into the half of the face of the upper roller which is turned towards the nip of the pair of output rollers. This can be achieved in a simple embodiment by giving the yarn guide the form of an essentially cylindrical projection of the upper roller on its side towards the grasping device, whereby the diameter of the projection is smaller than the diameter of the upper roller. Rapid introduction of the yarn end into the pair of output rollers can be assisted furthermore by providing the upper roller of the pair of output rollers with one or several notches between casing surface and face in its edge towards the grasping device.

With spinning machines it is customary today to carry out piecing with the help of a piecing carriage which travels alongside a machine having a plurality of identical spinning stations. When the device according to the invention is used in combination with a machine having a plurality of such spinning stations, it is of special advantage here too for one or several of the elements required solely for the piecing process to be installed on such a piecing carriage.

The instant invention makes it possible to carry out piecing in a reliable manner without changing the arrangement and mounting of the elements required for the normal spinning process and allows for spacesaving construction. The invention makes it futhermore possible to control the piecing process precisely in such a way that the length of the piecing joint in the yarn can be kept very short and can be predetermined exactly. In this way unobtrusive and strong piecing joints are obtained in the yarn.

The device according to the invention is at the same time simple in its construction and greatly facilitates the utilization of a piecing carriage since it is not necessary to adjust machine elements at the twisting unit or drawing equipment to carry out the piecing process. An electric control of air pressures or a rove stopping device which in any case can be controlled from the spinning station in case of yarn breakage is sufficient here. All other elements, required only for piecing, can be installed on the piecing carriage.

BRIEF DESCRIPTION OF THE DRAWINGS

The invention is explained in greater detail below through the examples of embodiments shown in the drawings.

FIG. 6 shows in a top view the output pair of drawing rollers of the drawing equipment, the twisting unit and a compressed air nozzle which is directed against the yarn end going through the twisting unit;

FIGS. 7*a* and 7*b* show the twisting nozzle or the injector nozzle of the twisting unit as well as the output of the compressed air nozzle in cross-section;

FIG. 8 shows the placement of the compressed air nozzle in relation to a twisting unit with only one set of compressed air perforations, in cross-section;

DETAILED DESCRIPTION OF THE PREFERRED EMBODIMENTS

Figure 1:
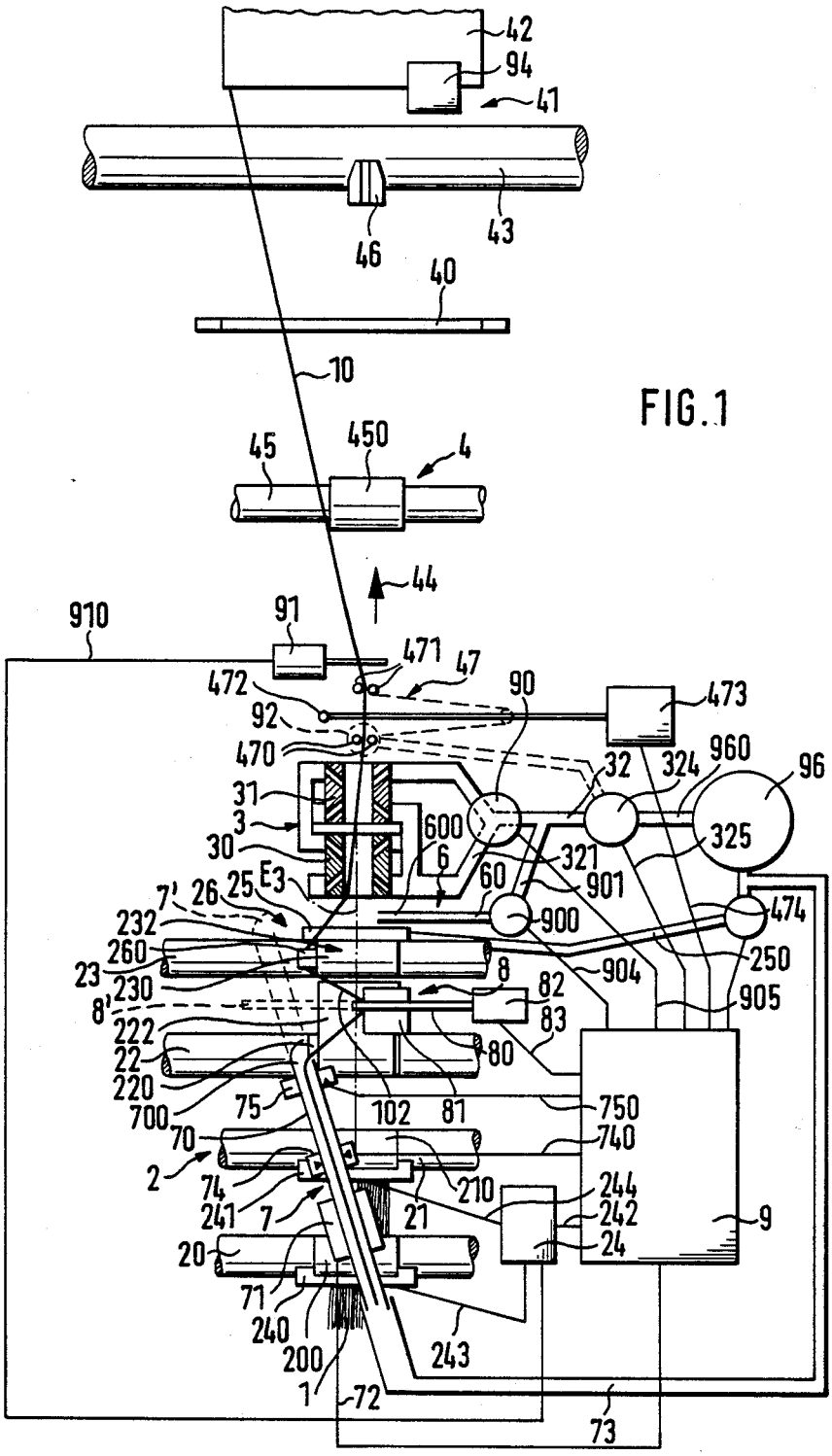
FIG. 1 is a schematic top view of a spinning device made in accordance with the invention.
Figure 2:
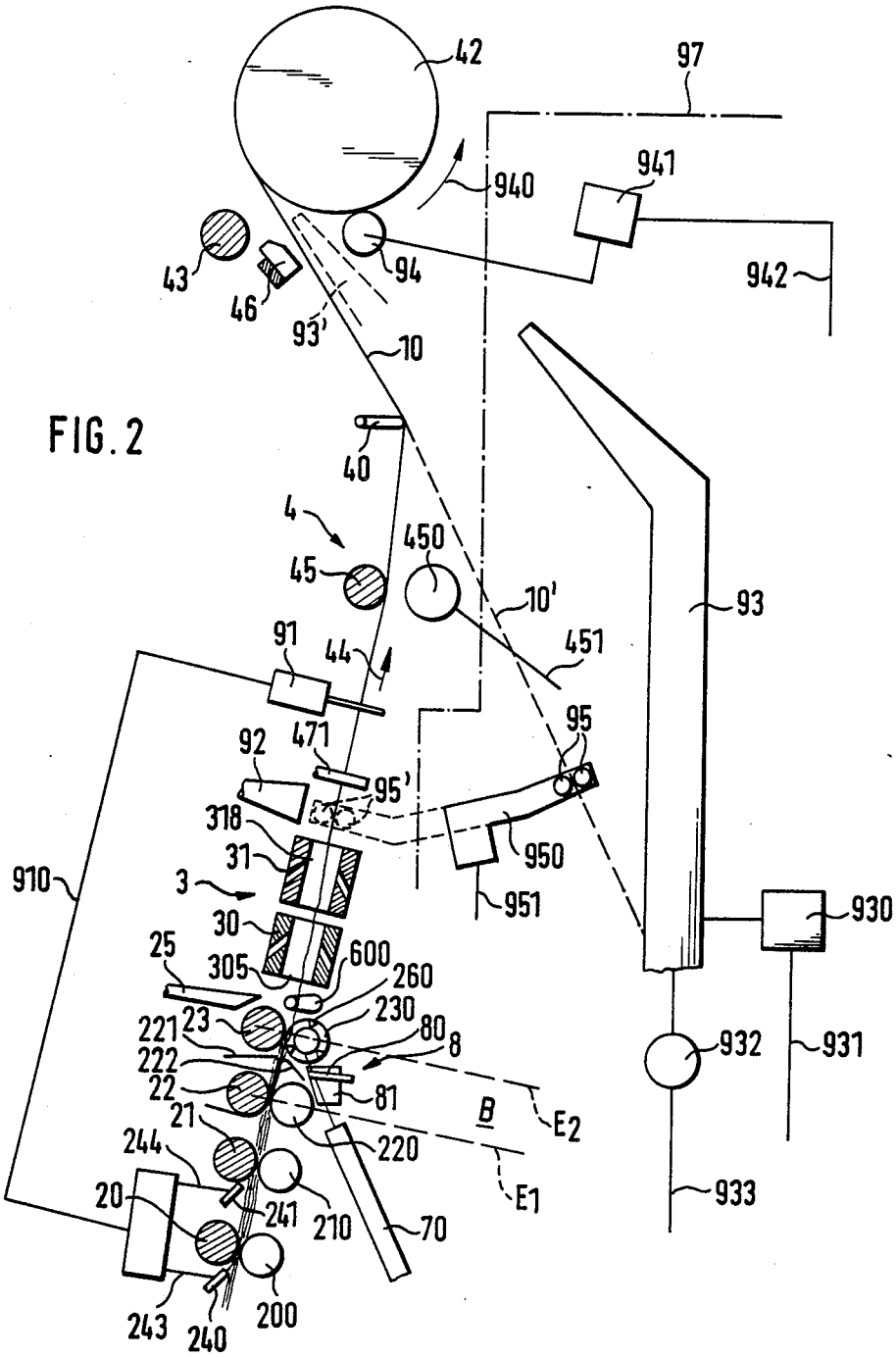
FIG. 2 is a schematic side view of the spinning device shown in FIG. 1.

The structure of the spinning device shall first be explained through FIGS. 1 and 2.

In the spinning device shown, a rove 1 or a fiber slier is stretched by means of drawing equipment 2 to the desired thickness and is then conveyed to a pneumatic twisting unit 3 where the rove or the fiber sliver is spun into a yarn 10. Yarn 10 is pulled out of the twisting unit 3 by means of a draw-off device 4 and is fed via a yarn tension compensation strap 40 to a winding device 41 where the yarn is wound up into a bobbin 42. The shown drawing equipment 2 has 4 pairs of drawing rollers consisting of rollers 20 and 200, 21 and 210, 22 and 220 as well as 23 and 230. A rove clamp 241 or 240 is installed in front of each of the rollers 21, 210 of the third-to-last pair of rollers, as well as in front of each of the rollers 20, 200 of the pair of rollers preceding this pair of rollers and a common driving device 24 is assigned to said rove clamps 241 or 240 (see activating connections 243 and 244).

Figure 10:
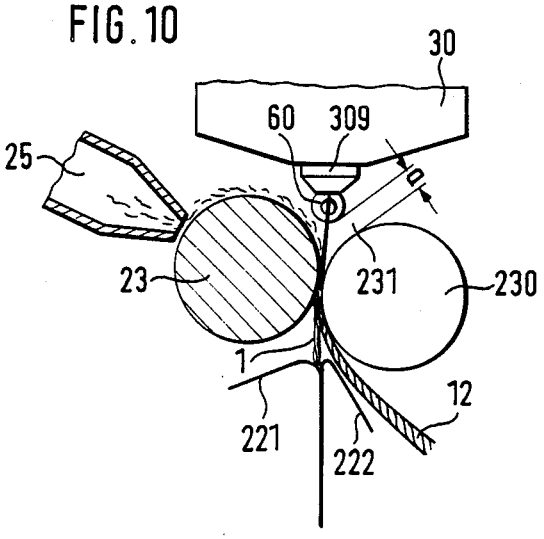
FIG. 10 is a side view of the detail shown in FIG. 9.

Each of the two rollers 22, 220 is surrounded by a small belt 221 or 222 (also see FIG. 10)

In the area between the drawing equipment 2 and the twisting unit 3, a suction nozzle 25 is assigned to the lower roller 23 of the pair of output drawing rollers 23, 230.

Figure 14:
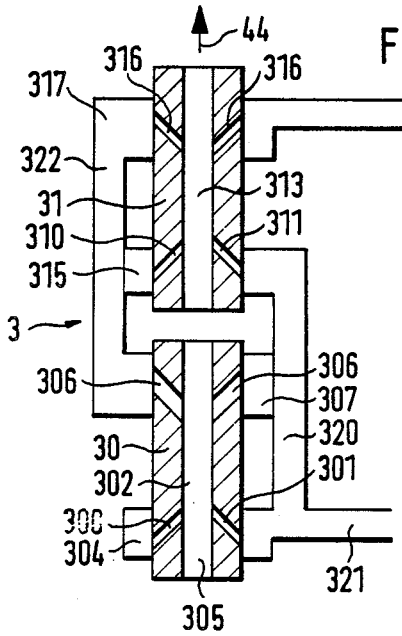
FIG. 14, shows a cross-section of the twisting unit shown in FIG. 1.

The compressed air which is conveyed to the pneumatic twisting unit 3 via a controllable compressed air circuit 32 imparts a false twist to the yarn 10, and this is subsequently reversed to a great extent. For this purpose, the shown twisting unit 3, is equipped with an injector nozzle 30 and a twisting nozzle 31, one after the other as seen in the direction of yarn draw-off, both supported by a common holding device (not shown). As FIGS. 7*b* and 14 show, the injector nozzle 30 is provided with two compressed air bores 300 and 301 which open tangentially into the axial bore 302 of the injector nozzle 30. FIGS. 7*a* and 14 show that the twisting nozzle 31 is provided with three compressed air bores 310, 311 and 312 which open tangentially into the axial bore 313 of twisting nozzle 31. A comparison between FIGS. 7*a* and 7*b* shows that the compressed air bores 300 and 301 open into their axial bore 302 in opposite direction to the compressed air bores 310, 311 and 312. This is illustrated by arrows 303 in FIG. 7*b* and 314 in FIG. 7*a*.

The compressed air bores 300 and 301 as well as 310, 311 and 312 are inclined in direction of draw-off (see arrow 44 in FIGS. 1 and 14), so that a motion component is imparted to yarn 10 in direction of this arrow 44 when the twisting unit 3 is subjected to over-pressure during the spinning process.

The compressed air bores 300, 301 or 310, 311 and 312, although they are tangential to the axial bore 302 or 313, are drawn for the sake of visualization in the sectional plane of injector nozzle 30 or twisting nozzle 31.

The radially outermost ends of the compressed air bores 300 and 301 are connected to a ring channel 304 surrounding the injector nozzle 30 and the compressed air bores 310, 311 and 312 of twisting nozzle 31 are connected to a ring channel 315 surrounding that nozzle (FIG. 14). The two ring channels 304 and 315 are connected to each other by a circuit 320 and to the compressed air circuit 32 via a connection circuit 321 and a reversing valve 90.

The draw-off device 4 normally consists of a driven draw-off roller 45 and of a pressure roller 450 which is applied against said draw-off roller 45 with elastic pressure and can be lifted up from the latter (FIG. 2).

The bobbin 42 is driven by a bobbin roller 43. For changeant laying of yarn 10 during winding, a shot yarn guide is installed in the conventional manner before the winding device 41.

On its way between the twisting unit 3 and the draw-off device 4, the yarn 10 is monitored by a yarn monitor 91 for the presence of spinning tension. The yarn monitor 91 is connected to the driving device 24 of the rove clamp devices 240 and 241 for control purposes in order to stop the rove 1 in case of yarn breakage while the drawing equipment 2 continues to run. This energy connection 910 is represented as a line.

Directly next to the path of the yarn, near the twisting unit 3, between the latter and the yarn monitor 91, is the output of a suction nozzle 92. This suction nozzle 92 has the role of sucking away loose fibers leaving the twisting unit 3 in form of fly during uninterrupted spinning operation or, in case of yarn breakage, of sucking away the rove section which continues to be fed by the drawing equipment 2 in form of a piece of yarn.

Before discussing the element required for piecing, the function of the spinning device the components of which were described above is to be explained:

During undisturbed spinning operation a fiber sliver or a rove 1 is fed to the drawing equipment. Upon leaving the drawing equipment 2, the fiber material enters the twisting unit 3. The reversal of the edges of the stretched fiber material between the rollers 23, 230 of the drawing equipment and the input opening 305 of the twisting unit 3 causes the ends of the outer fibers to spread out and away from the sliver-like fiber material.

The pneumatic twisting unit 3 imparts a certain amount of false twist to the core 100 of yarn 10, and this false twist is subsequently reversed to a great extent (see FIG. 3, zone IV). During the false twisting and when it is reversed the spread-out fiber ends are bound into the core 100 of yarn 10 while loops 101 are formed and thus ensure that yarn 10 is given the desired strength, whereby the position of the fiber ends in relation to the finished yarn 10 determine its hairiness.

The finished spun yarn 10 is drawn out of the twisting unit 3 by means of the draw-off device 4 and is fed to the bobbin 42 for winding, whereby yarn 10 is monitored by the yarn monitor 91 during draw-off.

To be able to repair a yarn breakage automatically in the described device, additional elements, to be described below, are required:

For the back-feeding of the yarn end 12 produced by a yarn breakage to the twisting unit 3, a pivoted suction pipe 93 can be assigned in known manner to the bobbin 42 capable of being lifted off the winding roller 43 (see position 93'), the drive arrangement 930 of said suction pipe 93 being indicated only schematically in FIG. 2. This suction pipe 93 is connected via a valve 932 to a source of negative pressure (not shown). To the bobbin 42 can furthermore be assigned, by means of a driving device 941, an auxiliary drive roller 94 capable of driving bobbin 42 in back-feeding direction (see arrow 940 in FIG. 2).

The suction pipe 93 is provided in a known manner with a slit (not shown) in its side toward the twisting unit 3 so that the yarn 10 can emerge from said slit when the suction pipe 93 is swivelled back from position 93' into the position shown in FIG. 2. The suction pipe 93 and the twisting unit 3 are provided with a pair of auxiliary rollers 95 which is installed on a pivoted holding device 950. This pair of auxiliary rollers 95 serves to take up the yarn end 12 once it has partially left suction pipe 93 through the slit (see position 10' in FIG. 2) and to guide it before the output opening 318 of the twisting unit 3 (see position 95').

A yarn reserve device 47 is located between the twisting unit 3 and the yarn monitor 91. This yarn reserve device 47 is provided with two yarn guides 470 and 471 between which a yarn deflection element 472 is movable transversely to the running direction of the yarn (see arrow 44). The yarn deflection element 472 is provided for this purpose with a driving device 473.

In addition to the compressed air bores 300 and 301 or 310, 311 and 312 the injector nozzle 30 and the twisting nozzle 31 are also provided with additional compressed air bores 306 or 316 which, in contrast to the compressed air bores 300, 301, 310, 311 and 312 do not open out tangentially but radially into the axial bore 302 or 313 (see FIG. 14) and are inclined counter to the draw-off device (arrow 44), so that they impart a motion component in back-feeding direction to the yarn end 12 when they are fed compressed air. These compressed air bores 306 are connected to a ring channel 307 and the compressed air bores 316 are connected to a channel 317, said channels being connected between each other by a circuit 322. The latter is connected via a connection circuit 323 and via the reversing valve 90 to a compressed air circuit 32.

As shown in FIG. 1, a compressed air nozzle 60, connected via a valve 900 and a connection circuit 901 to the compressed air circuit 32 is provided on the one side of the yarn path, between the twisting unit 3 and the drawing equipment 2. The orientation of the compressed air nozzle is essentially parallel to the nip of rollers 23, 230 of the drawing equipment 2. The compressed air nozzle 60 constitutes a yarn presentation device 6 which will be explained in greater detail further below.

In relation to path of the yarn determined by the axis of the twisting unit 3, the suction opening 700 of a suction pipe 70, constituting a pneumatic grasping device 7 is located across from the outlet 600 of the compressed air nozzle 60. This grasping device 7 is in position 7' in its receiving position and can be pulled back beside the drawing equipment 2 obliquely with respect to its upper rollers 200, 210, 220 and 230 up to the position shown in FIG. 1 (also see FIG. 2 for comparison) by means of a driving device 71.

If the axles of rollers 22, 220 and 23, 230 respectively define the planes E1 or E2 (see FIG. 2), these planes El and E2 delimit an area B between them. A yarn inserting device 8 is provided in this area B, consisting of a hook 80 according to FIG. 1, which by means of a driving device 82 can be moved essentially parallel to the rollers 22, 220 so that it crosses the yarn end 12 extending from the twisting unit 3 and past roller 230 to the suction pipe 70. The movement path of the yarn inserting device 8 is arranged so that the yarn end 12 is laterally deposited outside the rove path between belts 221, 222, i.e. on the side of belt 222 which is away from belt 221, so that the yarn end 12 is deflected by the roller 230. As FIG. 1 shows, yarn end 12 is in that case pulled into the drawing equipment 2 until hook 80 is located essentially in the cross-sectional plane E3 through drawing equipment 2, in extension of the axial bore 302 and 313 of the twisting unit 3.

The yarn inserting device 8 is provided with a yarn brake 81 between the last two pairs of rollers 22, 220 and 23, 230 of the drawing equipment 2, i.e. in area B, whereby the yarn end 12 can be applied during the insertion movement into the drawing equipment -by the yarn inserting device 8 against said yarn brake 81.

To produce the compressed air and suction air streams needed for the spinning and piecing, a source of negative pressure 96 (FIG. 1) is provided, the over-pressure side of which is connected via an over-pressure circuit 960 and a valve 324 to the earlier-mentioned compressed air circuit 32. The suction nozzle 92 is connected via a circuit 920, and the suction 70 is connected via a circuit 973 to the suction side of the negative pressure source 96, possibly via not-shown valves. In addition, the suction nozzle 25 is connected via a circuit 250 and a control valve 902 to the suction side of the negative pressure valve 96.

For the control of the piecing process, a control device 9 is provided, to which the components operating during the piecing process are connected for control purposes. In FIGS. 1 and 2 the energy connections between the control device 9 and each of the components to be controlled are represented by lines. These are the energy connection 942 for the driving device 941 of the auxiliary drive roller 94, the energy connection 931 for the driving device 930 and the energy connection 933 for valve 932 of suction pipe 93, the energy connection 451 for the lifting of the pressure roller 450 away from the draw-off roller 45, the energy connection 951 for the swivelling drive of holding device 950 of the pair of auxiliary rollers 95, the energy connection 474 for the driving device 473 of the yarn reserve device 47, and possibly an energy connection to a valve (not shown) that could be installed in the circuit 920 leading to suction nozzle 92, the energy connection 325 to the valve 324 between the source of negative pressure 96 and the compressed air circuit 32, the energy connection 905 to the reversing valve 90 serving to reverse the twisting unit 3 from spinning operation to back-feeding and vice-versa, the energy connection 904 to valve 900 for the control of the compressed air nozzle 60, the energy connection 903 to the control valve 902 for the suction nozzle 25, the energy connection 72 to the driving device 71 for the grasping device 7, possibly an energy connection to a valve (not shown) that may be installed in circuit 73 for a grasping device 7 in form of a suction pipe 70, the energy connection 83 to the driving connection 82 for the yarn inserting device 8 as well as the energy connection 242 to the driving device 24 of the two rove clamping devices 240, 241.

The function of the device shown in FIGS. 1 and 2 is explained below:

When a yarn breakage occurs during the spinning process, the yarn monitor 91 is triggered and then triggers the rove clamping devices 240, 241 via energy connection 910, causing rove 1 to be pressed against rollers 200 and 210 and thus to be held back. These two rollers 200 and 210 are lifted away from the driven rollers 20 and 21. The following roller pairs 22, 220 and 23, 230 however continue to convey the rove 1 in direction of the twisting unit 3, causing a break to occur in rove 1 between the rollers 21, 210 and 22, 220. This section of rove 1 which continues to be conveyed to the twisting unit 3 by drawing equipment 2 is spun into a short piece of yarn by the twisting unit 3 which continues to be subjected to over-pressure. Since this piece of yarn has no connection with the yarn 10 wound up on bobbin 42, this short piece of yarn is now sucked away by suction nozzle 92.

Simultaneously with the activation of the rove clamping devices 240, 241, the yarn monitor 91, by means which are not shown here, causes bobbin 42 to be lifted from bobbin roller 43 and thus to be stopped. Furthermore, this causes the lifting of the pressure roller 450 from the draw-off roller 45 (in a manner not shown here). Also, the arrival of compressed air to twisting unit 3 is halted by means of valve 324, and the sucking action at suction nozzle 25 is halted by means of control valve 902.

The spinning station is now prepared for piecing by means of control device 9. For this, reversing valve 90 is reversed and valve 324 is brought into flow-through position so that a stream of compressed air is produced in twisting unit 3, in opposite direction to the draw-off direction, i.e. counter to the direction of arrow 44. The twisting unit is cleaned by this stream of compressed air, whereby loosened fibers and dirt particles are removed through suction nozzle 25.

The yarn inserting device 8 is brought from the position shown in FIG. 1 into its position 8'. Once this is accomplished, grasping device 7 is moved from the position shown in FIG. 1 into position 7'.

The auxiliary drive roller 94 then takes over the role of supporting bobbin 42. The suction pipe 93 is brought from the position shown in FIG. 2 into position 93' and negative pressure is produced within it by activating valve 932. Auxiliary drive roller 94 is now driven in back-feeding direction and rotates bobbin 42 in the direction of arrow 940, so that the yarn end 12 produced when the yarn broke is unwound from bobbin 42 and is sucked away in accordance with the reversed rotation of bobbin 42 under the action of the suction air stream prevailing in suction pipe 93. Suction pipe 93 is now moved back into the position shown in FIG. 2, causing the yarn end 12 to come out of the slit (not shown) of suction pipe 93 and to assume position 10'. The auxiliary pair of rollers 95 is now swivelled from a readiness position (not shown) into position 95', whereby it grasps the yarn end which is in position 10' and brings it in front of the output opening 318 of the twisting unit 3 and thereby into range of the air flow prevailing in said twisting unit 3. Thereby a yarn reserve of defined size is constituted in a manner not shown here between the yarn guides 470, 471 by means of the yarn deflection element 472. The auxiliary drive roller 94 and thereby also bobbin 42 are then stopped.

Cutting means (not shown) have reduced yarn 10 to a suitable length during this process.

Continued back-feeding of the yarn end 12 into the twisting unit 3 is effected by reverse rotation of the auxiliary roller pair 95 and by release of the previously constituted yarn reserve. The compressed air stream prevailing in the compressed air bores 316 and 306 of the twisting unit 3 assist here the back-feeding of the yarn end 12 in direction of the drawing equipment 2. Valve 900 is now activated so that a stream of compressed air also emerges from compressed air nozzle 60 and is oriented transversely to the conveying direction of yarn end 12 (in opposite direction to arrow 44), seizing the yarn end 12 emerging from the output opening 305 of the twisting unit 3 and bringing it to the pneumatic grasping device 7 which is waiting in its position 7', so that the stream of compressed air blows the yarn end 12 precisely into the suction opening 700 of the suction pipe 70.

The release of the yarn reserve by means of the yarn reserve device 47 occurs so slowly that the compressed air nozzle 60 is able to maintain the yarn end 12 which is leaving output opening 305 constantly in a straight line while it is being brought to grasping device 7, thus ensuring greater reliability of piecing and improving the aspect of the piecing joint.

Suction pipe 70 now aspires yarn end 12. As soon as yarn end 12 is securely held by suction pipe 70, valve 324 is activated and this halts the arrival of compressed air to the twisting unit 3 and to the compressed air nozzle 60, so that the yarn end 12 can be fed back as safely as possible and in order to avoid untwisting of the yarn end 12.

When a sufficient length of yarn has been sucked into the suction pipe 70, the latter is pulled back from position 7' into the position shown in FIGS. 1 and 2. An appropriate movement of the grasping device 7 during its pull-back movement from position 7' into the shown position causes the yarn end 12 to be pulled past the upper roller 230 of the pair of output rollers 23, 230 and up to a position alongside the drawing equipment 2, whereby yarn end 12 comes to be applied laterally against the upper roller 230 of said drawing equipment 2. A suitable configuration of the upper roller 230, e.g. a chamfered configuration (not shown) ensures that the yarn end 12 is held in the nip area of rollers 23, 230, independently of the direction of movement of grasping device 7 during the further draw-back and of the subsequent movement of the yarn inserting device 8.

When the grasping device 7 has reached its position as shown in FIG. 1, the back-feeding of yarn end 12 is ended. Yarn end 12 assumes a defined position within the suction pipe 70 since the back-fed yarn length has been measured out exactly by the yarn reserve device.

The supply of compressed air to the compressed air bores 316 and 306 is now suppressed.

At this point in time the hook 80, which was in position 8' until now, is pulled into the position shown in FIG. 1. As FIG. 2 shows, the yarn end 12 is brought at the same time to the side away from roller 22 of belt 222 of a yarn brake 81 while a loop 102 is formed, and is applied against said side of the belt.

At the same time, bobbin 42 is again driven in draw-off direction (arrow 44) by means of the auxiliary drive roller 94 and the pressure roller 450 previously lifted up from the draw-off roller 45 is again applied against the driven draw-off roller 45, so that yarn end 12 is again drawn off through the twisting unit 3. Furthermore, valve 324 is again activated and the reversing valve 90 is reversed. Thereby a first compressed air stream oriented in draw-off direction (arrow 44) takes effect within the twisting unit while a second compressed air stream takes effect transversely to the direction of draw-off (arrow 44).

The rove 1 which was stopped until that moment by the rove clamping devices 240, 241 is now released.

The compressed air stream of compressed air nozzle 60 blows during this time upon the yarn end 12 which is in draw-off and prevents said yarn end 12 from pulling single fibers with it. The blown-off fibers are caught by suction pipe 70 and are sucked away. For this purpose suction 70 has again been brought into its position 7' upon execution of the insertion movement by the yarn inserting device 8.

After a certain time, determined by control device 9, this compressed air stream is switched off in the compressed air nozzle 60 by activation of valve 900, whereupon suction pipe 70 can also return into its starting position shown in FIGS. 1 and 2. This time is determined by the control device 9 so that the yarn end 12 has been drawn off from the drawing equipment to a predetermined length.

When the stream of compressed air in the compressed air nozzle 60 has been switched off, a compressed air stream in draw-off direction (arrow 44) is produced through activation of valve 324 and of the reversing valve 90. Rove 1, together with the yarn end 12, now enters the twisting unit 3 and is incorporated in said twisting unit 3 into the yarn end 12 so that a new yarn 10 is now spun from rove 1 after incorporation of the beginning of the rove into the yarn end 12.

Hook 80 which is applied against the yarn brake 81 and said yarn brake 81, together constitute an elastic yarn clamp which brakes the yarn end 12 during yarn draw-off so that the yarn end 12 cannot pull back, even after being released by grasping device 7, and thus cannot enter the nip of rollers 23, 230 and into the twisting unit 3 in a curled-up, i.e. non-straightened state. A perfect piecing joint is ensured in this manner.

The suction nozzle 25 is directed upon the lower roller 230 of the pair of output rollers 23, 230 of the draw-off roller unit 2 and therefore has only an insignificant or no effect in the area of the yarn path between drawing equipment 25 and twisting unit 3. A control of suction nozzle 25 can therefore be dispensed with as a rule. If suction air nozzle 25 was nevertheless switched off by means of a valve (not shown) during the piecing process, it can now be switched back on so that these loose fibers, which may have caught on roller 23 of the drawing equipment 2, can be sucked away by it. The upper roller 230 can also be provided with a cleaning suction or brush.

Figure 3:
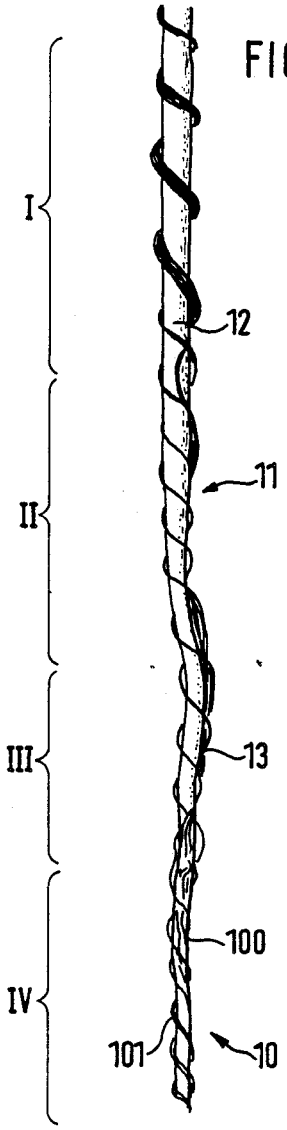
FIG. 3 is a schematic representation of a piecing joint from which the loose fibers were not blown off during the piecing process.
Figure 4:
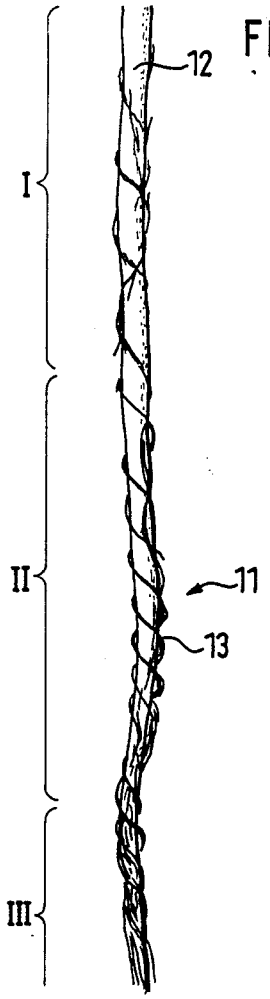
FIG. 4 is a schematic representation of another piecing joint from which the fibers were blown off during the piecing process.

The function of the compressed air nozzle 60 after resumption of yarn draw-off is explained in greater detail through FIGS. 3 and 4:

The beginning of a rove 1 which was previously clamped by a rove clamping device 240, 241, always has an irregular appearance. An accumulation of material occurs here which is not desired in piecing joint 11. The compressed air nozzle 60, when it is switched back on after resumption of yarn draw-off, has therefore the role of blowing away excess material from the yarn end 12.

FIG. 3 shows piecing joint 11 as it would be if the compressed air nozzle 60 did not take effect upon resumption of draw-off, while piecing joint 11, as shown in FIG. 4, was constituted with the help of the compressed air nozzle 60.

As shown in FIG. 3, the piecing joint 11 can be divided into three zones I, II and III, followed by a zone IV in form of the normally spun yarn 10:

In zone I, all the fibers arriving in the twisting unit 3 are wound through the twisting action of the injector nozzle 30 into loose spirals around the stretched yarn end 12. The yarn spun in zone I is thus not very strong, so that a danger of material being pushed together exists.

In zone II the fiber stream constitutes a core 13 which comes to lie almost at a parallel against yarn end 12. A smaller portion of the fibers constitutes the wind-around fibers (loops 101) which wind around the two cores (yarn end 12 and new fiber material). The length of this zone II determines the strength of the piecing joint 11.

Based on the fact that the yarn end is no longer clamped between the rollers 23, 230 of the drawing equipment 2 at the moment of incorporation, said yarn end 12 is no longer incorporated in a straightened position into the newly formed yarn.

Zone IV, in which the yarn 10 consists exclusively of fibers fed to it from drawing equipment 2 follows zone III.

If the compressed air nozzle 60 is then brought into action for a certain period after resumption of yarn draw-off, it removes the fibers which are loosely looped around yarn end 12 (zone I), as shown in FIG. 4. Only a relatively small amount of fibers is deposited here, since approximately 90% of the fibers supplied by the drawing equipment 2 are removed by the compressed air nozzle 60.

Since the effect of the compressed air nozzle 60 cannot be suppressed suddenly because of the length of circuits 32 and 321, said compressed air nozzle 60 continues to take effect also into zone II of the piecing joint 11. Fibers are then blown away here too, and as a result the mass distribution of the piecing joint 11 is improved. Zone II here resembles Zone II of FIG. 3. Zone III is also the same in both described processes (see FIGS. 3 and 4).

The compressed air nozzle 60 is completely shut off, at the latest when the yarn end 12, previously back-fed for piecing, leaves the rollers 23, 230 of the drawing equipment 2, in order to avoid the occurrence of a thin spot in the new yarn 10 after zone III.

Figure 5:
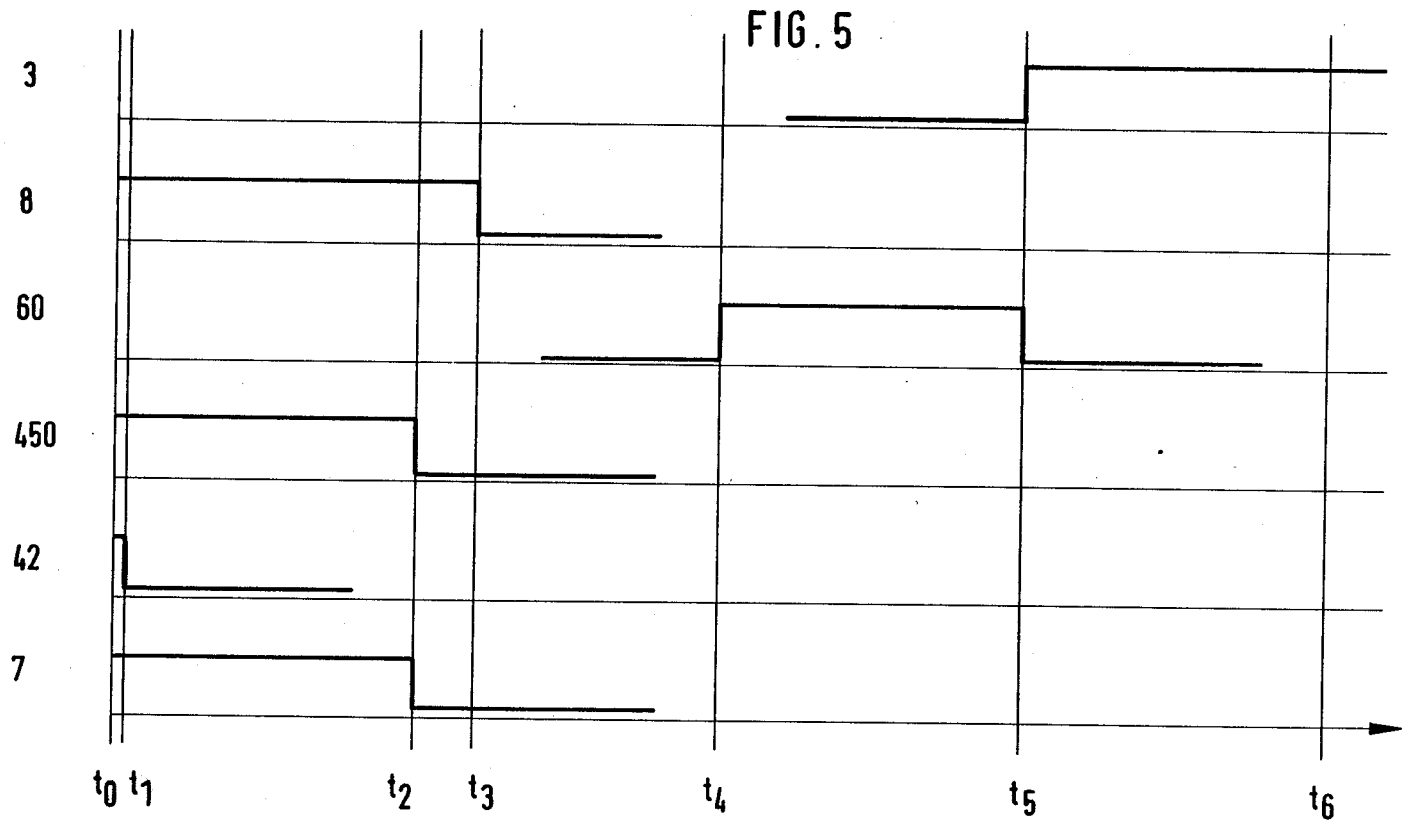
FIG. 5 is a function and time diagram with indication of the operations required after deposing of the yarn end alongside the drawing rollers for the purpose of piecing.

In the above-described process, in which yarn draw-off begins before the rove 1 is again released, there is the disadvantage that another yarn segment which has been formed from a length of rove 1 that has not been exactly drawn follows piecing joint 11, as a certain amount of time is always necessary until the drawing of the released rove 1 becomes uniform once more. To prevent this length of rove 1 from getting into the piecing joint 11, piecing is carried out as follows according to a modified process (see also FIG. 5):

After back-feeding of the yarn end 12 into grasping device 7 has been completed, rove 1 is released ($t_o$) through activation of the rove clamping device 240, 241. The rove beginning leaving rollers 23, 230 is sucked off by suction nozzle 25. At the same time, or shortly after release of rove 1, bobbin 42 is lowered on the bobbin roller 43 ($t_1$). The grasping device 7 is then brought from its position 7' into its position alongside the drawing equipment 2 as shown in FIG. 1, and the pressure roller 450 is again applied against the driven draw-off roller 45 ($t_2$). Following this, the yarn end 12 which is already in the process of being drawn off is inserted into the output drawing roller pair 23, 230 and is applied by means of the yarn inserting device 8 against the yarn brake 81 ($t_3$).

The compressed air nozzle 60 is now also brought temporarily into action so that the yarn end 12, in the process of being drawn off, is reliably prevented from pulling along either rove 1 or loose fibers ($t_4$, $t_5$).

The rove 1 and the fibers blown off yarn end 12 are sucked off by suction nozzle 25 and/or by suction pipe 70 which has in the meantime been brought back in to position 7'. Once the compressed air nozzle 60 has again been shut off, a stream of compressed air in the direction of draw-off (see arrow 44) is finally produced inside twisting unit 3 through activation of valve 324 and of the reversing valve 90.

The point in time for the release of rove 1 and the point in time to switch on yarn draw-off are synchronized by the control device 9 so that the yarn end 12 reaches the rollers 23, 230 of the drawing equipment 2 only after the length of rove 1 which has deteriorated as a result of rove 1 having been stopped when yarn breakage occurred has been sucked off by suction nozzle 25.

As the above description shows, a number of elements are required only for piecing but not for the normal spinning process. These elements are in particular the control device 9 and the auxiliary driving roll 94 which it controls, suction pipe 93, the auxiliary roller pair 95, the yarn reserve device 47, the compressed air nozzle 60, the grasping device 7 as well as the yarn inserting device 8 and the yarn brake 81 associated to this yarn inserting device 8. It is therefore possible and advantageous to arrange these elements on a service unit 97 (see FIG. 2) which controls the piecing process. This service unit 97 is capable of traveling alongside a plurality of identical spinning stations A, B, C ... (see FIG. 12) of the machine and repairs such a yarn breakage as needed at any one of the spinning stations A, B, C, ...

According to FIG. 14, the nozzles of the twisting unit 3 (injector nozzle 30, twisting nozzle 31) lined up in a row in direction of draw-off (arrow 44) are positioned at an axial distance from each other with a gap 34 between them. During pneumatic back-feeding of yarn end 12 through the twisting unit 3 this creates the danger for the forward end to catch at the output side of the injector nozzle 30 during this back-feeding. To avoid this danger, a stronger air flow is produced within injector nozzle 30 in back-feeding direction than in the twisting nozzle 31. This can be accomplished by aligning the compressed air bore 316 accordingly more in the direction of back-feeding (counter to arrow 44), while the compressed air bore 36 would be less aligned by comparison in back-feeding direction. According to the embodiment shown in FIG. 14, the back-feeding air stream is choked more heavily in the twisting nozzle than in the injector nozzle 30. As shown in FIG. 14, the compressed air bores 306 in the injector nozzle 30 are given a greater diameter for that purpose than the compressed air bores 316 in the injector nozzle 31. The same effect can also be obtained by installing different numbers of compressed air bores 306, 316 in the injector nozzle 30 and in twisting nozzle 31.

The pneumatic back-feeding of the yarn end 12 can be effected alternatively, if desired, by means of a compressed air nozzle (not shown) which can be attributed to the output 318.

In order to always ensure that the yarn leaving the input opening of the twisting unit 3 is properly fed to the grasping device 7, whatever fiber material is to be spun or whatever yarn thickness is to be obtained, this yarn feed is effected according to FIG. 1 by means of a compressed air nozzle 60 the outlet 600 of which has an inside diameter of constant cross-section. A steady stream of compressed air is thus produced.

If the slow back-feeding of yarn end 12 to the compressed air nozzle 60 is obtained through corresponding reverse rotation speed of the auxiliary roller pair 95, the yarn reserve device 47 can be dispensed with.

If a yarn reserve device 47 is used, yarn guide 470 can be eliminated if the twisting unit 3 assumes its role.

To obtain secure and non-damaging feeding of yarn end 12 to the grasping device 7, so that yarn end 12 is not dissolved in the air stream, the stream of compressed air leaving the compressed air nozzle 60 is set as weakly as possible, especially if grasping device 7 is pneumatically operated. To blow away fibers and to hold the rove 1 back from the yarn end 12 in the process of being drawn off it is advantageous on the other hand, if the stream of compressed air is stronger. For this reason the compressed air nozzle 60 is equipped with a device for the selective application of low over-pressure during yarn back-feeding and higher over-pressure at the start of yarn draw-off. This device can consist of a reversing valve which connects the compressed air nozzle 60 alternately to over-pressure sources of different strengths, or it may consist of valve 900 if the latter is made in form of a choke and is capable of assuming an intermediary position in addition to the closed and open positions.

To obtain non-damaging feeding of yarn end 12 to the grasping device 7 it is advisable to leave the compressed air nozzle 60 switched on only until the back-feeding through twisting unit 3 is completed, and to switch it off even earlier if possible, as soon as the grasping device 7 has securely grasped the yarn end 12. For this purpose a common control valve 324 precedes the twisting unit 3 as well as the compressed air nozzle 60 according to FIG. 1.

Figure 9:
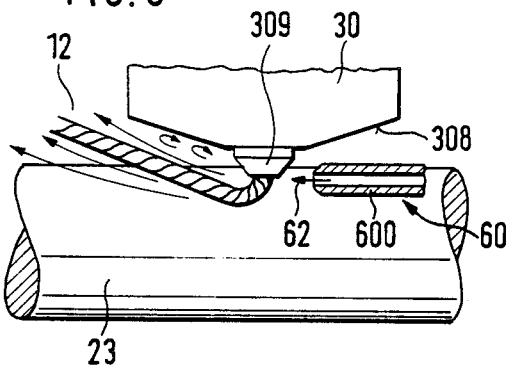
FIG. 9 is a top view of the placement of the compressed air nozzle in relation to the output pair of drawing rollers of the drawing equipment.

In order to ensure that the yarn end 12 cannot come to lie against a roller 23, 230 of the drawing equipment 2 during the feeding of the back-fed yarn 10 to the grasping device 7, the twisting unit 3 is designed as shown in FIG. 9. As this illustration clearly shows, the twisting unit has an axial projection 309 at its input side 308, receiving the input opening 305 of the twisting unit 3. The compressed air nozzle is positioned here in such a relationship to the projection 309 of the twisting unit 3 that the compressed air stream leaving the compressed air nozzle 60 is tangent to the front of the projection 309 of the twisting unit 3. As seen in direction of the air flow, turbulence is created as a result behind the axial projection 309 of the twisting unit 3, deflecting the yarn end 12 in direction of the twisting unit 3 and thus moving it away from the rollers 23, 230.

It has been shown that especially good spinning results are obtained if the twisting unit 30 is as close as possible to the rollers 23, 230 of the drawing equipment 2. To make this possible, the compressed air nozzle 60 is located, according to FIGS. 9 and 10, at least partially in the nip 231 of rollers 23, 230 of the drawing equipment 2 on the side of the twisting unit 3. In order to prevent fly from accumulating on the upper roller 230, it has been shown to be advantageous for the compressed air nozzle 60 to be at a minimum distance a of 1 mm from the upper roller 230 of the drawing equipment 2.

As was explained earlier in connection with FIG. 3, the fibers are wound by the injector nozzle 30 around core 100 of yarn 10 . This balloon twist is indicated in FIG. 7*b* by an arrow 303. The yarn core is however given a core twist (see arrow 319) in the twisting nozzle 31, in the opposite sense of the balloon twist (see arrow 314) in the twisting nozzle 31. In order to achieve an especially good blow-off effect, the compressed air nozzle 60 is arranged tangentially to the yarn end 12 extending from the drawing equipment 2 to the twisting unit 3, as shown in FIGS. 6, 7*a*, 7*b*, in the opposite sense of the core twist (arrow 319). Since this core twist is caused by the compressed air bores 310, 311 and 312, the compressed air nozzle 60 (see FIG. 7*a*) is oriented counter to the peripheral direction into which these compressed air bores 310, 311 and 311 open out into the axial bore 313 of the twisting nozzle 31. By comparing FIGS. 7*a* and 7*b* with FIG. 8, it can be seen that such a tangential arrangement of the compressed air nozzle 60 is not only possible when the twisting unit 3, as seen in direction of yarn draw-off (see arrow 44) is provided with two rows of compressed air bores 300, 301 and 310, 311, 312 one behind the other, but also with twisting units having one single row of compressed air bores 330, 331. In the former instance the core twist (arrow 319) is always produced by the second nozzle (twisting nozzle 31) by means of the second row of compressed air bores 310, 311 and 312, said nozzle acting for that purpose with greater strength upon yarn end 12 (three compressed air bores 310, 311, 312 as compared with two compressed air bores 300, 301 in the injector nozzle). However, if the twisting unit 3 only has one single row of compressed air bores 330, 331, these compressed air bores provoke the balloon twist (see arrow 332) as well as the core twist (see arrow 319). In that case the compressed air nozzle 60 is thus oriented counter to the peripheral direction of the air flow produced by the compressed air bores 330, 331 in the twisting unit 3.

As a result of this orientation of the compressed air stream leaving the compressed air nozzle 60, loose fibers are detached most efficiently from the yarn end 12 being drawn off, and an especially favorable retention of the rove 1 being fed to suction nozzle 25 is achieved.

Although especially advantageous, it is not absolutely necessary for the intake suction opening 700 of the suction pipe 70 to be turned towards the compressed air nozzle 60. Especially with a mechanical configuration of the yarn feeder 6 it can be most practical for the intake suction opening 700 of the suction pipe 70 to be concentric with the axis of the suction pipe 70.

A grasping device 7 in the form of a suction pipe 70 can also remain in its position 7' during the entire piecing process if the suction pipe 70 is provided with an oblong slit (not shown) (possibly capable of being controlled) through which an intermediate segment of the fed-back yarn end 12 can emerge to come into the path of movement of yarn inserting device 8.

Figure 12:
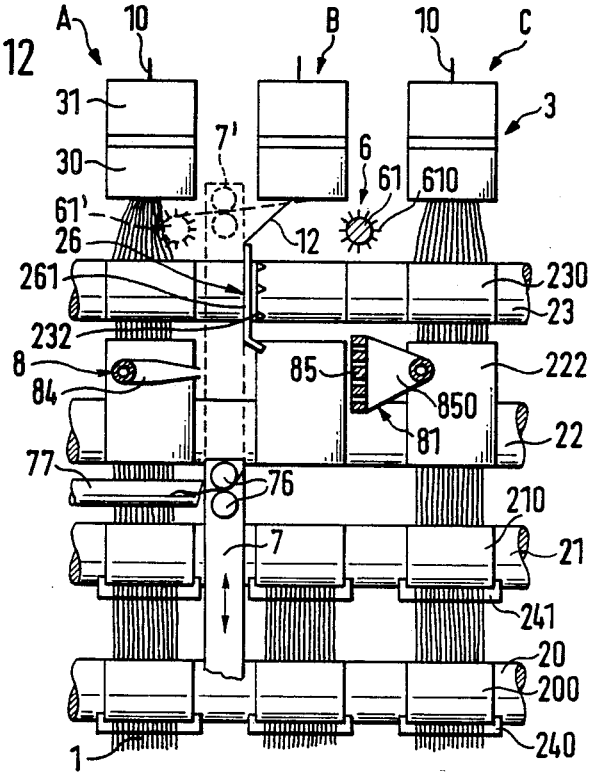
FIG. 12 is a top view of a modified device according to the invention.

If the above description mentions that the grasping device 7 is pulled back until it lies alongside the drawing equipment 2, this not only means a withdrawal of the grasping device 7 laterally from the drawing equipment (as shown in FIG. 12). It also means another withdrawal of the grasping device 7 outside the drawing equipment 2, e.g. above it, i.e. on the side of rollers 200, 210, 220 and 230 away from the rollers 20, 21, 22 and 23.

If the yarn end 12 is inserted into the pair of output rollers 23, 230 through appropriate configuration and/or movement of the grasping device 7, the yarn inserting device 8 can be dispensed with. Depending upon the configuration of grasping device 7, the yarn brake 81 can also be eliminated, especially if the grasping device is a mechanical model or may be installed in the grasping device 7 in case of a pneumatic model. In this case it is advantageous for such a yarn brake 81 to take effect only during resumed yarn draw-off.

The insertion of the yarn end 12 into the nip of rollers 23, 230 of the drawing equipment 2 can be ensured by appropriate arrangement and/or retraction of the grasping device 7, whereby threading of the yarn end 12 into the nip can be assisted by chamfering the peripheral edge of the roller 230. Alternatively, one or several notches 232 can be provided in the edge closest to the grasping device 7, between the casing surface and the facing of roller 23. These notches 232 seize the yarn end 12 lying at an angle and then pull it into the nip between rollers 23, 230.

In order to further facilitate the insertion of yarn end 12 into the nip of the rollers 23, 230 of drawing equipment 2 as the grasping device 7 is retracted and/or during the insertion movement of the yarn inserting device 8, it is recommended to provide the upper roller 23 with a yarn guide 26. This yarn guide ensures that the yarn end 12 is held in the half of the upper roller 230 on the side of the nip of the pair of output rollers 23, 230, whatever the path of movement of grasping device 7 as it is retracted, so that it cannot get into the area of the upper half of upper roller 230, which would render an introduction into the nip of rollers 23, 230 impossible.

Such a yarn guide can be given different configurations. In a simple embodiment this yarn guide, as shown in FIGS. 1, 2 and 6, is made in form of an essentially cylindrical projection 260 of the roller 230. This projection 260 is turned towards the path of movement of grasping device 7 and has a diameter d which is smaller than the diameter D of the roller 230 (see FIG. 6).

Alternatively, instead of a cylindrical projection 260 of roller 230, it is also possible to provide a yarn guide 26 with the form of a hoop 261 (see FIG. 12). Such a hoop can also be installed on a service carriage 97 if desired (see broken line indication in FIG. 2), since this yarn guide is needed merely during the piecing process.

To ensure that the back-fed yarn end 12 is held securely by the pneumatic grasping device 7 it is advantageous for the back-fed yarn length to be longer than required and for the yarn length required for piecing to be determined only after completed back-feeding of said yarn length. For this purpose the suction pipe 70 is provided with a cutting device 74 according to FIG. 1 which cuts the yarn 10 extending within suction pipe 70 down to a desired length at the desired moment through control of the control device 9 (see active connection 740). For example, this cutting action can occur when the suction pipe 70 has reached its position as shown in FIG. 2 but before the yarn inserting device 8 has started its insertion movement.

It is advantageous if the piecing joint length can be determined. This is advantageous especially because different minimum lengths are required for the piecing joint 11 depending on the material and yarn thickness involved. For this reason the suction pipe 70 is provided with a yarn monitoring device 75 according to FIG. 1, which is connected for control to the control device 9 (see active connection 750). In this way a signal can be transmitted by the yarn monitoring device 75 which, according to FIG. 1, is made in form of a photoelectric barrier to the control device 9 when the yarn end 12 passes this yarn monitoring device 75. The control device 9 contains a time function element (not shown) which can be set to different values and which controls the compressed air nozzle 60.

As shown in FIG. 1, a grasping device 7 in form of a suction pipe 70 need not be provided with a control valve to control the negative pressure prevailing within it. If however the negative pressure effect is to be controlled, it is important in order to obtain sufficient retention force for yarn end 12 during insertion into the drawing equipment 2, for the negative pressure to be switched off only after this insertion of the yarn end 12. As mentioned before, this insertion of yarn end 12 into the drawing equipment 2 is effected through the retraction movement of the suction pipe 70 and at the latest through the movement of yarn inserting device 8.

The yarn brake 81 can be provided with a retention clothing, e.g. in form of a burry coating. As mentioned, the yarn brake 81 can however also constitute an elastic yarn clamp together with the yarn inserting device 8 and can pe provided for that purpose with a resilient clamping surface against which the yarn inserting device 8, which is connected to its drive 82 for that purpose via a spring (not shown), is resiliently applied. The resilient clamping surface of yarn brake 81 can be made of soft rubber, felt or similar material.

The above description shows that the explained process and the described device can be modified in many ways within the framework of the instant invention, for example by replacing individual features by equivalents or by combining them differently. Thus it is not necessary to lift the pressure roller 450 from the draw-off roller 45 for the insertion of yarn 10 if the insertion of the yarn into the draw-off device 4 can be ensured in some other manner by means of guiding elements and through an appropriate configuration of the pressure roller 450. Neither is it absolutely necessary for yarn feeding or for the grasping of yarn end 12 that pneumatically operating elements be used. It is furthermore possible to replace the yarn inserting device 8, which is mechanical according to FIG. 1, and the mechanical yarn brake 81 by pneumatic elements. Such an embodiment of the device is explained below through FIG. 12.

In the embodiment shown in FIG. 12 the yarn feeder 6 is mechanical, i.e. in form of a pin 61 which is capable of being moved transversely to the extended axis of the twisting unit 3, essentially parallel to the rollers 23, 230. This pin 61 is provided with a retention clothing 610, which could be burry for example, on its outer periphery. When the yarn end 12 has left the twisting unit 3 as it is being back-fed, this yarn end 12 is slaved by the pin 61 in its movement from the position shown in FIG. 12 into its position 61'. In order to ensure that the yarn end 12 is indeed received by the retention clothing 610, it is also possible to impart slight rotation to the pin 61 if desired.

Since the feeding speed towards grasping device 7 depends on the transfer speed of the yarn feeder 6 if the latter is a mechanical model, a yarn reserve device 47 can be dispensed with.

According to FIG. 12, the grasping device 7 is not made in form of a suction pipe 70 but is provided with a pair of rollers 76. When pin 61 has reached its position 61', the grasping device 7, with its roller pair 76 is brought into its position 7', whereby an appropriate relative motion between grasping device 7 and pin 61 or yarn guides (not shown) ensure that the back-fed yarn enters the nip zone of the roller pair 76.

When the yarn end 12 is securely held by the roller pair 76, the grasping device 7 is again brought back from its position 7' into its starting position shown in FIG. 12. The roller pair 76 then comes within range of a suction nozzle 77 which sucks the free end of the yarn end 12 held by said roller pair 76. If necessary, this suction nozzle 77 can also be provided with a yarn cutting device (not shown).

A compressed air nozzle 84 is used as the yarn inserting device in the embodiment shown in FIG. 12, while a sieve 85 subjected to negative pressure via a suction pipe 850 serves as the yarn brake. This sieve furthermore assists the work of the compressed air nozzle 84 in inserting the yarn end 12, whereby the yarn length required for this is released by reversing the roller pair 76.

It is of course also possible to provide a mechanical grasping device 7 in combination with a mechanical yarn inserting device 8 and a mechanical yarn brake 81, whereby the clamping pressure of the roller pair 76 can merely be sufficiently weak so that the movement of the yarn inserting device 8 and the draw-off movement of the yarn 10 suffice to pull yarn end 12 out of the roller pair 76 without opening or reversing the latter.

Figure 11:
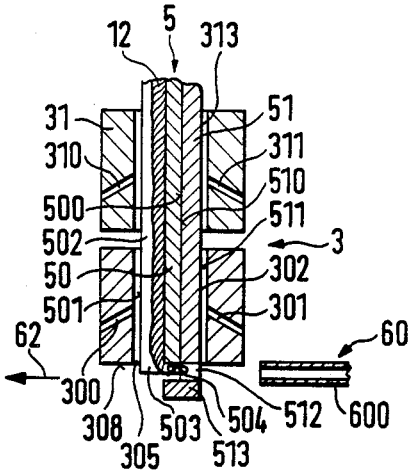
FIG. 11 is a twisting unit with a threading element made in form of a clamp.
Figure 13:
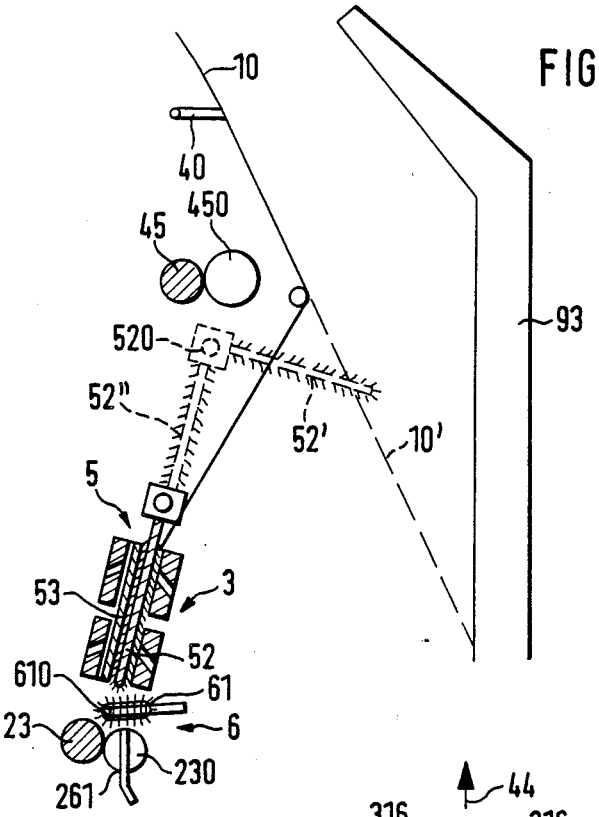
FIG. 13 shows a detail of a modified embodiment of the object of the invention, with a cleaning and threading device made in form of a brush, in schematic side view.

FIGS. 11 and 13 show further variations of the above-described device, in which the back-feeding of the yarn end 12 through the twisting unit 3 as far as into the operating range of the yarn feeder 6 is not effected by means of a stream of compressed air, but in which a mechanical threading element 5 is provided for that purpose.

According to the embodiment shown in FIG. 11, the threading element 5 is made in form of a clamp and consists of two parts 50 and 51 capable of being moved in relation to each other. The two parts 50 and 51 have guide surfaces 500 and 510 facing each other, while their other pheripheral surfaces 501 or 511 are adapted to the from of the axial bore 302, 313 of the twisting unit 3. To receive the yarn end 12, part 50 of the threading element 5 is provided on its side away from part 51 with a longitudinal groove 502 which becomes a transversal groove 503 on its side towards the input opening 305 of the twisting unit.

FIG. 11 shows the threading element 5 in its release position. It can be seen from this drawing that the part 51 of the threading element is provided with a recess 512 essentially in prolongation of the transversal groove 503. In axial direction with respect to part 51, a clamping surface 513 capable of being applied against the facing 504 of part 50 of the threading element 5, but not as far as into the zone of the longitudinal groove 502 follows this recess 512.

Yarn end 12 is received by the threading element outside the twisting unit 3 in a manner which is not shown here, for example from its position 10' shown in FIG. 2. The yarn end 12, which has been cut for this purpose to a predetermined length so that it does not extend beyond the recess 512, is thereby held between the clamping surface 513 and the facing 504 of the threading element 5. The threading element 5 is now introduced axially from the output side of the twisting unit 3 into said twisting unit 3 until it projects from the input opening 305 of said twisting unit 3. Part 50 is at the same time held so that its face 504 is essentially at the level of input side 308 of the twisting unit 3. Part 51 is moved a little further so that the free end of the yarn end 12 is released by the clamping surface 513. When the compressed air nozzle 60 is subjected to over-pressure, the free end of the yarn end 12 is blown out of the threading element 5 in direction of arrow 62 and is fed to the grasping device 7 when an additional length of yarn is brought through the longitudinal groove 502 into range of this stream of compressed air leaving the compressed air nozzle 60. As soon as the yarn end 12 has been seized by the grasping device, the threading element 5 can be withdrawn while yarn end 12 is not taken along as a result.

In the embodiment shown in FIG. 13 the threading element 5 is made in form of a brush 52. This brush 52 is pivotably supported on a holding device 520 so that it can be brought into the shown position 52' to receive the yarn end 12 which is in position 10' and so that it can then be brought back into the position in which it is positioned in prolongation of the axial bore 302, 313 of the twisting unit 3. By means of an axial movement the brush 52 can thus be introduced into the twisting unit until the free end extends beyond the input side 308 of the twisting unit 3 facing the drawing equipment 2.

When the brush 52 is in its position 52', the yarn end 12 is taken from position 10', whereby this can be further assisted by an appropriate rotation of brush 52. Brush 52 thereby assumes such a position in relation to the yarn end in position 10', that said yarn end 12 is located at the free end of brush 52 and so that the yarn end 12 can simple be taken off by the yarn feeder 6 after introduction of the brush 52 into the twisting unit. According to FIG. 13, this yarn feeder 6 is therefore a mechanical model.

After reception of yarn end 12 by the yarn feeder 6 and/or the grasping device 7, the brush 52 can be pulled back out of the twisting unit 3, whereby the yarn end 12 is prevented by the yarn feeder 6 or the grasping device 7 from following the brush.

To lower the friction between yarn end 12 and brush 52 while the latter is being retracted, the embodiment of brush 52 according to FIG. 13 is provided with a stripper 53 which, through its configuration, causes the yarn end 12 to be lifted out of the brush 52. During the introduction and retraction movement of the brush 52 into or out of the twisting unit 3, brush 52 cleans the axial bore 302, 313 of the twisting unit. This ensures the removal of accumulations which may have been deposited in the twisting unit 3 during the piecing process.

We claim:

1. Process for piecing with a spinning device operating with a pneumatic twisting unit downstream from drawing equipment having at least one pair of output rollers on an output side thereof, so that a yarn end is back-fed from the output side of the twisting unit through the twisting unit to the drawing equipment and is then inserted laterally into the pair of drawing equipment output rollers, from where it is subsequently drawn off through the twisting unit in the form of a continuous yarn while a rove is incorporated into it, such process including conveying the yarn end through the twisting unit located after the pair of drawing equipment output rollers to the twisting unit input side, seizing the yarn end there at such unit input side and conveying the yarn end to a grasping device located at the side of the drawing equipment, which grasping device then pulls the yarn end past the drawing equipment for subsequent insertion into the pair of output rollers.

2. Process as in claim 1, wherein such yarn end back-feeding through the twisting unit includes subjecting the yarn end to a compressed air stream oriented essentially parallel to the nip of the pair of output rollers for conveyance of such yarn end to the grasping device.

3. Process as in claim 2, wherein the conveyance of the year end being back-fed through the twisting unit towards the grasping device is effected by means of a laminar compressed air stream.

4. Process as in claim 2, wherein a yarn reserve is formed before back-feeding of the yarn end through the twisting unit, with such yarn reserve being used up relatively slowly during back-feeding of the yarn end through the twisting unit into a compressed air stream flowing transversely to the path of the yarn so that the yarn end is maintained in a straight line by the compressed air stream while it is being conveyed to the grasping device.

5. Process as in claim 2, wherein the compressed stream is switched off as soon as the yarn end has been seized by the grasping device.

6. Process as in claim 2, wherein upon resumption of yarn drawn-off, the yarn end and the rove are subjected, in the region between the pair of drawing equipment output rollers and the twisting unit, to a compressed air stream which is essentially parallel to the nip of the pair of output rollers.

7. Process as in claim 6, wherein said parallel compressed air stream which is switched on after resumption of yarn draw-off is subsequently switched off even before the yarn end leaves the pair of output rollers.

8. Process as in claim 6, wherein a considerably weaker compressed air stream is brought to bear upon the yarn end during yarn back-feeding than after resumption of yarn draw-off.

9. Process as claim 2, wherein said compressed air stream is directed tangentially against the core twist of yarn extending from the drawing equipment to the twisting unit.

10. Process as in claim 1, wherein said twisting unit is cleaned of loose fibers and fly before or during the back-feeding of the yarn end.

11. Process as in claim 1, wherein the yarn end is brought by a compressed air stream from the output side of the twisting unit through said twisting unit and into range of another compressed air stream flowing transversely to the path of the yarn for conveying the yarn end to the grasping device.

12. Process as in claim 11, characterized in that the compressed air stream flowing transversely to the path of the yarn during the pneumatic back-feeding of the yarn end through the twisting unit only remains effective for as long as the compressed air stream causing the yarn end to be back-fed flows in the twisting unit.

13. Process as in claim 1, wherein the grasping device functions pneumatically to produce negative pressure therein at least until the yarn end is inserted into the drawing equipment output rollers.

14. Process as in claim 1, wherein the yarn end is pulled in the form of a loop into an area between two last roller pairs of the drawing equipment after having been pulled to the side of the drawing equipment.

15. Process as in claim 14, wherein during each pulling of the yarn end in the form of a loop, the yarn end is brought into the effective range of a yarn brake.

16. Process as in claim 1, wherein the yarn end is brought into the area of the nip of the pair of output rollers during insertion into the drawing equipment.

17. Process as in claim 1, wherein the twisting unit is cleaned by a first compressed air stream flowing from the output side of the twisting unit to its input side, the yarn end is then subjected to such first compressed air stream to be back-fed to the input side of the twisting unit and is there exposed to a second compressed air stream taking effect transversely to the conveying direction of the yarn end which conveys the yarn end to the grasping device, which then pulls the yarn end past the pair of output rollers unit it is at the side of the drawing equipment, whereupon the previously stopped rove is released and is sucked away between the drawing equipment and the twisting unit, and wherein the yarn end extending towards the grasping device is then conveyed in the area between the last pair of drawing equipment rollers in the form of a loop to a yarn brake and is thereby inserted into the pair of drawing equipment output rollers and is again subjected to draw-off, and in that simultaneously arrival of the rove and of loose fibers into the twisting unit through suction is prevented by again switching on the second compressed air stream, in that the suction to remove the rove as well as the second compressed air stream are switched off even before the yarn end has reached the pair of output rollers of the drawing equipment, and finally in that the spinning over-pressure flowing in the yarn draw-off direction is brought to bear in the twisting unit.

18. Process as in claim 1 wherein the twisting unit is cleaned by a first compressed air stream flowing counter to the yarn drawoff direction, the yarn end is then exposed to such first compressed air stream and is brought by it from the output side of the twisting unit to its input side, and it is there exposed to a second compressed air stream taking effect transversely to the direction of conveyance and is conveyed by it to the grasping device which then pulls the yarn end past the pair of output rollers until it is at the side of the drawing equipment, and wherein the yarn end extending towards the grasping device is then conveyed in the form of a loop in the area between two last pairs of rollers of the drawing equipment to a yarn brake and is thereby inserted into the pair of output rollers for the drawing unit, whereupon the yarn end is again subjected to yarn draw-off, and further wherein the previously stopped rove is thereupon released while loose fibers are prevented from being sucked into the twisting unit by again switching on the second compressed air stream, and wherein the second compressed air stream is switched off when the yarn end has been pulled out of the drawing equipment for a predetermined length, and the spinning over-pressure taking effect in the yarn draw-off direction is brought to bean in the twisting unit.

19. Device for piecing on a spinning apparatus equipped with a pneumatic twisting unit, situated downstream from a pair of output rollers of drawing equipment, comprising a back-feeding element to back-feed a free yarn end from the output side of the twisting unit to its input side, a grasping device to pull back the yarn end from the input side of the twisting unit past said pair of drawing equipment output rollers until it is at the side of the drawing equipment, and a yarn presenting device for seizing the yarn end emerging from the input side of the twisting unit during back-feeding and for conveying it to said grasping device.

20. Device as in claim 19, wherein said yarn presenting device comprises a compressed air nozzle parallel to the nip of said pair of output rollers, the outlet of which nozzle is located on a side of the twisting unit opposite said grasping device and turned towards said grasping device.

21. Device as in claim 20, wherein said twisting unit is provided with an axial projection at its input side, and said compressed air nozzle is positioned in such manner with respect to the twisting unit that a compressed air stream leaving the compressed air nozzle is tangent to the face of said projection.

22. Device as in claim 20, wherein said compressed air nozzle is located at least in part within the nip on the side of twisting unit of the pair of output rollers of the drawing equipment, and on the side of said twisting unit.

23. Device as in claim 22, wherein the compressed air nozzle is at a distance of at least 1 mm from an upper roller of said pair of output rollers of the drawing equipment.

24. Device as in claim 20, wherein said outlet of the compressed air nozzle has an inside diameter of constant cross-section.

25. Device as in claim 20, wherein said twisting unit is provided with several compressed air bores causing the core of yarn therein to be twisted, opening out tangentially into the inside of the twisting unit, and said compressed air nozzle is positioned tangentially to the yarn end extending from the drawing equipment to the twisting unit and is at the same time oriented counter to the direction of flow of the compressed air bore causing the twisting of the core of the yarn end which is produced by the compressed air bores in the twisting unit.

26. Device as in claim 25, wherein said twisting unit is provided with a single row of compressed air bores letting out tangentially into the axial bore of the twisting unit, and said compressed air nozzle is oriented tangentially to the prolonged axial bore of the twisting unit in a direction opposite to the direction of flow of the compressed air flow leaving the compressed air bores.

27. Device as in claim 25, wherein said twisting unit is provided with two rows of compressed air bores, one behind the other in the direction of yarn draw-off, of which one row opens out in a peripheral direction and the other row in the opposite peripheral direction tangentially into the axial bore of the twisting unit, and said compressed air nozzle is oriented tangentially to the prolonged axial bore of the twisting unit counter to that peripheral direction into which the compressed air bores of the second row in the direction of yarn draw-off open out into the axial bore of the twisting unit.

28. Device as in claim 20, wherein said compressed air nozzle is provided with means for selectively supplying it with a higher or lower over-pressure.

29. Device as in claim 20, wherein said compressed air nozzle is provided with a control device for selectively controlling operation thereof, and said grasping device is provided with a yarn monitoring device connected to said control device for indicating to said control device whether the yarn end resides at said grasping device.

30. Device as in claim 19, wherein said twisting unit includes compressed air bores adapted for being supplied with over-pressure during spinning and which provide an air flow component in the yarn draw-off direction, and includes additional compressed air nozzles in which an over-pressure prevails during yarn back-feeding and which provides an air flow component in the yarn back-feeding direction.

31. Device as in claim 30, further including a common supply circuit and a common control valve provided for the compressed air bores of the twisting unit (3) for pneumatic back-feeding of the yarn end and for the compressed air nozzle.

32. Device as in claim 19, wherein said twisting unit is provided with an injector nozzle and with a twisting nozzle behind it, directed generally in the yarn draw-off direction, and separated by a gap, and is provided with an injector nozzle, said injector nozzle as well as said twisting nozzle being provided with at least one compressed air bore oriented in the yarn back-feeding direction, and wherein a stronger air stream can be produced in said injector nozzle than in said twisting nozzle.

33. Device as in claim 32, wherein the compressed air bore in said injector nozzle has a greater diameter than the compressed air bore in said twisting nozzle.

34. Device as in claim 19, further including a mechanical threading element for back-feeding of the yarn end into stroke range of said yarn presenting unit.

35. Device as in claim 34, wherein said mechanical threading element comprises a clamp.

36. Device as in claim 34, wherein said threading element comprises a brush.

37. Device as in claim 36, wherein said brush is provided with a stripper for selectively removing the yarn end therefrom.

38. Device as in claim 19, further including a yarn reserve device with a drive located at the output side of said twisting unit for selectively forming a yarn reserve, said device driving the yarn reserve device so slowly that the yarn end leaving the input opening of the twisting unit is held in a straight line by the yarn presenting device while being fed to the grasping device.

39. Device as in claim 19, wherein grasping device comprises a suction air nozzle.

40. Device as in claim 39, wherein said suction air nozzle is provided with a suction opening turned towards the yarn presenting device.

41. Device as in claim 19, wherein said grasping device is movable between a receiving position in which it works together with the yarn presenting device, and an inserting position alongside of the drawing equipment.

42. Device as in claim 19, further including a yarn inserting device which can be moved from a readiness position at the side of the drawing equipment into an insertion position in such manner that it crosses the path of the yarn end extending from the twisting unit to the grasping device 17 and introduces said yarn end in continued movement thereof into the drawing equipment.

43. Device as in claim 42, further including a yarn brake to which the yarn end can be conveyed during its insertion movement into the drawing equipment.

44. Device as in claim 43, wherein said yarn brake is located in an area between two last pairs of rollers of said drawing equipment.

45. Device as in claim 44, wherein said yarn insertion device in its insertion position together with said yarn brake comprises an elastic clamp means.

46. Device as in claim 45, wherein said yarn brake against which the yarn inserting device presses the yarn end is provided with a clamping surface made of soft rubber or felt.

47. Device as in claim 19, wherein an upper roller of the pair of output rollers of the drawing equipment is provided with a yarn guide which holds the yarn end in the half of the face of the upper roller which is turned towards the nip of such pair of output rollers while the yarn end is being pulled back to the side of the drawing equipment until it is inserted into the drawing equipment.

48. Device as in claim 47, wherein said yarn guide is constituted by an axial, essentially cylindrical projection of the upper roller on its side towards the grasping device, and wherein the diameter of said projection is smaller than the diameter of the upper roller.

49. Device as in claim 47, wherein said upper roller is provided with at least one notch in its edge towards the grasping device between the casing and the face.

50. Device as in claim 19, further including a piecing carriage capable of travelling alongside a plurality of spinning stations each provided with a respective twisting unit and corresponding drawing equipment, with at least one of the elements required for piecing carried on said carriage.

51. A method of piecing on a spinning device operating with a pneumatic twisting unit, said method comprising:

sensing a yarn breakage;

clamping rove being fed to the twisting unit, in an area of drawing equipment upstream from the twisting unit, while removing rove between such area and the twisting unit, and stopping twisting operations of the pneumatic twisting unit;

back-feeding a free yarn and through the twisting unit to an input side thereof;

conveying such free yarn end laterally as it emerges from the twisting unit input side, and thereafter grasping such free end;

pulling the grasped free and past an output roller pair of the drawing equipment, and applying such yarn end laterally against such rollers; and releasing the clamped rove, while resuming rove feeding, yarn draw-off, and twisting operations of the twisting unit, such that the rove together with the yarn and enters the twisting unit to be incorporated therein into such yarn end, so that new yarn is spun in the twisting unit and continuously drawn therefrom, whereby piecing is effected.

52. A method as in claim 51, further including forming a yarn reserve before back-feeding the free yarn end through the twisting unit, so that said yarn reserve is used up slowly during back-feeding of the yarn end through the twisting unit for generally maintaining a straight line path for such yarn end while it is being laterally conveyed to be grasped.

53. A method as in claim 51, wherein upon resumption of yarn draw-off, the yarn end and the rove are subjected, between said drawing equipment pair of output rollers and the twisting unit, to a compressed air stream for removing fibers which are loosely looped around the yarn end.

54. A method as in claim 51, wherein said back-feeding includes producing a stream of compressed air within said pneumatic twisting unit which is opposite to a yarn draw-off direction, such oppositely directed compressed air also serving to clean said twisting unit by loosening fibers and dirt particles therein to be removed through suction.

55. Apparatus for piecing on a spinning device operating with a pneumatic twisting unit, said apparatus comprising:

yarn monitoring means for sensing a yarn breakage and outputting a signal indicative of same;

means for receiving said signal and control responsively initiating a piecing operation which includes suspending twisting operations of said twisting unit;

rove clamp means, responsive to said control means, at a for clamping rove being fed to said twisting unit, predetermined area of drawing equipment upstream from said twisting unit;

a controllable suction nozzle, situated relatively adjacent the input side of said twisting unit and responsive to said control means, for suctioning loose roving between said rove clamp means and said twisting unit;

means, responsive to said control means, for back-feeding a free yarn end from a bobbin through said twisting unit to the input side thereof;

yarn presenting means, responsive to said control means, for laterally displacing said free yarn end as it emerges from said twisting unit input side;

yarn grasping means, situated generally to the side of the upstream drawing equipment and responsive to said control means, for grasping such laterally displaced yarn end and transporting such grasped yarn end past an output roller pair of the drawing equipment and then laterally back against such rollers for driving engagement therewith; and means for sensing such engagement of the grasped free yarn end with the drawing equipment rollers and signalling said control means thereof, whereupon said control means is operative to release said rove clamp means, and to resume yarn draw-off and twisting unit twisting operations, such that the rove together with the yarn end enters said twisting unit to be incorporated therein into such yarn end, so that a new yarn is spun in the twisting unit and continuously drawn therefrom;

whereby piecing is effected without requiring lateral shifting of said twisting unit in order to properly back feed the free yarn end to the drawing equipment for subsequent yarn draw-off operations.

56. Apparatus as in claim 55, wherein said yarn presenting means comprises a compressed air nozzle oriented essentially parallel to the nip of the the pair of drawing equipment output rollers, the outlet of which nozzle is located on the side of said twisting unit opposite said grasping means and is turned towards said grasping means.

57. Apparatus as in claim 55, wherein said compressed air nozzle is located at least in part within the nip of the pair of output rollers of the drawing equipment, and on the side of said twisting unit.

58. Apparatus as in claim 55, wherein said means for back-feeding includes a mechanical threading means for the back-feeding of the yarn end into operative range of the yarn presenting means.

59. Apparatus as in claim 58, wherein said threading means comprises a clamp.

60. Apparatus as in claim 58, wherein said threading means comprises a brush.

61. Apparatus as in claim 60, wherein said brush is provided with a stripper for selectively removing the yarn end therefrom.

62. Apparatus as in claim 55, wherein said means for back-feeding includes a yarn reserve device with a drive located at the output side of said twisting unit, which drive drives the yarn reserve device so slowly that the yarn end leaving the input opening of said twisting unit is held in a generally straight line by said yarn presenting means while being moved towards said grasping means.

63. Apparatus as in claim 55, wherein said grasping means comprises a suction air nozzle.

64. Apparatus as in claim 63, wherein said suction air nozzle is provided with a suction opening turned towards said yarn presenting means.

65. Apparatus as in claim 55, wherein said grasping means is movable between a defined receiving position in which is cooperates with said yarn presenting means, and a defined inserting position alongside the drawing equipment.

66. Apparatus as in claim 55, further including yarn inserting means movable between a defined readiness position at the side of the drawing equipment and a defined insertion position such that it crosses the path of the yarn end extending from said twisting unit to said grasping means and introduces said yarn end in continued movement thereof into the drawing equipment.

67. Apparatus as in claim 66, wherein said yarn inserting means comprises a controllably movable hook means.

68. Apparatus as in claim 66, further including a yarn brake to which the yarn end can be conveyed during its insertion movement into the drawing equipment.

69. Apparatus as in claim 68, wherein said yarn brake is located in an area between two last pairs of rollers of said drawing equipment.

* * * * *